US011358825B2

(12) United States Patent
Yoshida et al.

(10) Patent No.: US 11,358,825 B2
(45) Date of Patent: Jun. 14, 2022

(54) POST PROCESSING APPARATUS AND IMAGE FORMING SYSTEM

(71) Applicants: Nagayasu Yoshida, Kanagawa (JP); Akihiro Tsuno, Kanagawa (JP)

(72) Inventors: Nagayasu Yoshida, Kanagawa (JP); Akihiro Tsuno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/237,446

(22) Filed: Apr. 22, 2021

(65) Prior Publication Data

US 2021/0331889 A1 Oct. 28, 2021

(30) Foreign Application Priority Data

Apr. 28, 2020 (JP) ..... JP2020-079463

(51) Int. Cl.
*B65H 37/04* (2006.01)
*B65H 31/04* (2006.01)
(Continued)

(52) U.S. Cl.
CPC ..... *B65H 37/04* (2013.01); *B31F 5/001* (2013.01); *B41L 43/12* (2013.01); *B65H 31/04* (2013.01); *B65H 31/34* (2013.01); *B65H 2301/4213* (2013.01); *B65H 2408/12* (2013.01); *G03G 2215/00822* (2013.01); *G03G 2215/00827* (2013.01); *G03G 2215/00848* (2013.01)

(58) Field of Classification Search
None
See application file for complete search history.

(56) References Cited

U.S. PATENT DOCUMENTS 5,217,215 A * 6/1993 Ohata ..... B42C 1/125 270/58.16
7,407,156 B2 * 8/2008 Iizuka ..... B65H 31/24 270/58.11
(Continued)

FOREIGN PATENT DOCUMENTS

JP 2002-087693 3/2002
JP 2009-001420 1/2009
(Continued)

*Primary Examiner* — Leslie A Nicholson, III
(74) *Attorney, Agent, or Firm* — Harness, Dickey & Pierce, P.L.C.

(57) ABSTRACT

A post-processing apparatus includes a binding device, a closing device, a driver, and a changeover switch. The binding device binds a sheet bundle. The closing device closes an entrance to a binding position at which the binding device binds the sheet bundle. The driver moves the closing device to a closing position to close the entrance. The switch performs switching to implement a state in which the binding device is able to bind the sheet bundle when the closing device moves to the closing position. The closing device includes an avoidance operation portion to move to the closing position to operate the switch, and a drive coupler coupled to the avoidance operation portion to move the avoidance operation portion to the closing position. A coupling state between the avoidance operation portion and the drive coupler is released when movement of the avoidance operation portion to the closing position is prevented.

9 Claims, 24 Drawing Sheets

(51) Int. Cl.

| | |
|---|---|
| ***B65H 31/34*** | (2006.01) |
| ***B31F 5/00*** | (2006.01) |
| ***B41L 43/12*** | (2006.01) |

(56) References Cited

U.S. PATENT DOCUMENTS

| | | | | |
|---|---|---|---|---|
| 7,828,281 | B2 * | 11/2010 | Terao | B65H 29/52 271/84 |
| 7,950,642 | B2 * | 5/2011 | Taki | B65H 31/3027 270/37 |
| 8,023,880 | B2 * | 9/2011 | Terao | G03G 21/1638 399/407 |
| 8,047,523 | B2 * | 11/2011 | Terao | B65H 31/10 270/58.11 |
| 8,047,525 | B2 * | 11/2011 | Taki | B65H 31/3081 270/58.17 |
| 8,109,497 | B2 * | 2/2012 | Okamoto | B65H 45/18 270/58.14 |
| 2014/0138896 | A1 | 5/2014 | Yoshida et al. | |
| 2015/0321872 | A1 | 11/2015 | Hari et al. | |
| 2017/0203935 | A1 | 7/2017 | Hari et al. | |
| 2018/0251332 | A1 | 9/2018 | Hari et al. | |

FOREIGN PATENT DOCUMENTS

| | | |
|---|---|---|
| JP | 2009-263027 | 11/2009 |
| JP | 2010-247956 | 11/2010 |
| JP | 2014-214023 | 11/2014 |

* cited by examiner

FIG. 21

| State of changeover switch 297 | State of protection switch 2982 | Power supply to stapler 209h | Status description |
|---|---|---|---|
| 0: The gap between the shutter 293 and driver unit 292 is wider than the thickness of predetermined number of sheets to be bound. | 0: Protection cover 2981 is open. | 0: Power supply is off. | When the gap between the driver unit 292 and the clincher 291 is large and the protection cover 2981 is not closed, power is not supplied to the stapler 209h. |
| 0: The gap between the shutter 293 and driver unit 292 is wider than the thickness of predetermined number of sheets to be bound. | 1: Protection cover 2981 is closed. | 1: Power supply is on. | The gap between the the driver unit 292 and the clincher 291 is large. However, the protection cover 2981 is closed and no foreign matter has entered. Accordingly, power is supplied to the stapler 209h. |
| 1: The gap between the shutter 293 and driver unit 292 is smaller than the thickness of predetermined number of sheets to be bound. | 1: Protection cover 2981 is closed. | 1: Power supply is on. | The gap between the the driver unit 292 and the clincher 291 is small. The protection cover 2981 is closed and no foreign matter has entered. Accordingly, power is supplied to the stapler 209h. |
| 1: The gap between the shutter 293 and driver unit 292 is smaller than the thickness of predetermined number of sheets to be bound. | 0: Protection cover 2981 is open. | 1: Power supply is on. | The gap between the the driver unit 292 and the clincher 291 is small and the protection cover 2981 is open. However, no foreign matter has entered and safety is ensured. Accordingly, power is supplied to the stapler 209h. |

POST PROCESSING APPARATUS AND IMAGE FORMING SYSTEM

CROSS-REFERENCE TO RELATED APPLICATION

This patent application is based on and claims priority pursuant to 35 U.S.C. § 119(a) to Japanese Patent Application No. 2020-079463, filed on Apr. 28, 2020, in the Japan Patent Office, the entire disclosure of which is hereby incorporated by reference herein.

BACKGROUND

Technical Field

Embodiments of the present disclosure relate to a post processing apparatus, and an image forming system.

Description of the Related Art

There is known an image forming apparatus that forms an image on a sheet. A post-processing apparatus that performs a sheet aligning function for aligning end portions of sheets and binding on a bundle of aligned sheets are also known. There is also known an image forming system that includes an image forming apparatus and a post-processing apparatus and binds and ejects a bundle of sheets on which images have been formed.

There is also known a conventional post-processing apparatus includes a shutter mechanism that prevents an object (foreign object), which is different from a sheet bundle as a target for the binding process, from entering the binding space (processing region) of a stapler. Some conventional shutter mechanisms include a sensor that detects the presence or absence of a foreign object in a processing region.

There is known a technology in which a shutter that covers a vicinity of a binding unit is provided, and a sensor detects a difference in thickness between a sheet bundle and a foreign object, thereby preventing entry of the foreign object thicker than the sheet bundle even when the sheet bundle is removed from the binding unit.

SUMMARY

In an aspect of the present disclosure, a post-processing apparatus includes a binding device, a closing device, a driver, and a changeover switch. The binding device is configured to bind a sheet bundle. The closing device is configured to close an entrance to a binding position at which the binding device binds the sheet bundle. The driver is configured to move the closing device to a closing position at which the closing device closes the entrance. The changeover switch is configured to perform switching to implement a state in which the binding device is able to bind the sheet bundle when the closing device moves to the closing position. The closing device includes an avoidance operation portion configured to move to the closing position to operate the changeover switch, and a drive coupler coupled to the avoidance operation device to move the avoidance operation portion to the closing position by a driving force caused by the driver. A coupling state between the avoidance operation portion and the drive coupler is released when movement of the avoidance operation portion to the closing position is prevented.

In another aspect of the present disclosure, an image forming system includes an image forming apparatus and the post-processing apparatus. The image forming apparatus is configured to form an image on a sheet. The post-processing apparatus is configured to bind a sheet bundle of sheets on which images have been formed by the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 12 including

FIG. 21 is a chart describing a control pattern for a stapler of a post-processing apparatus according to the ninth embodiment of the present disclosure; and FIG. 22 including

Figure 1:
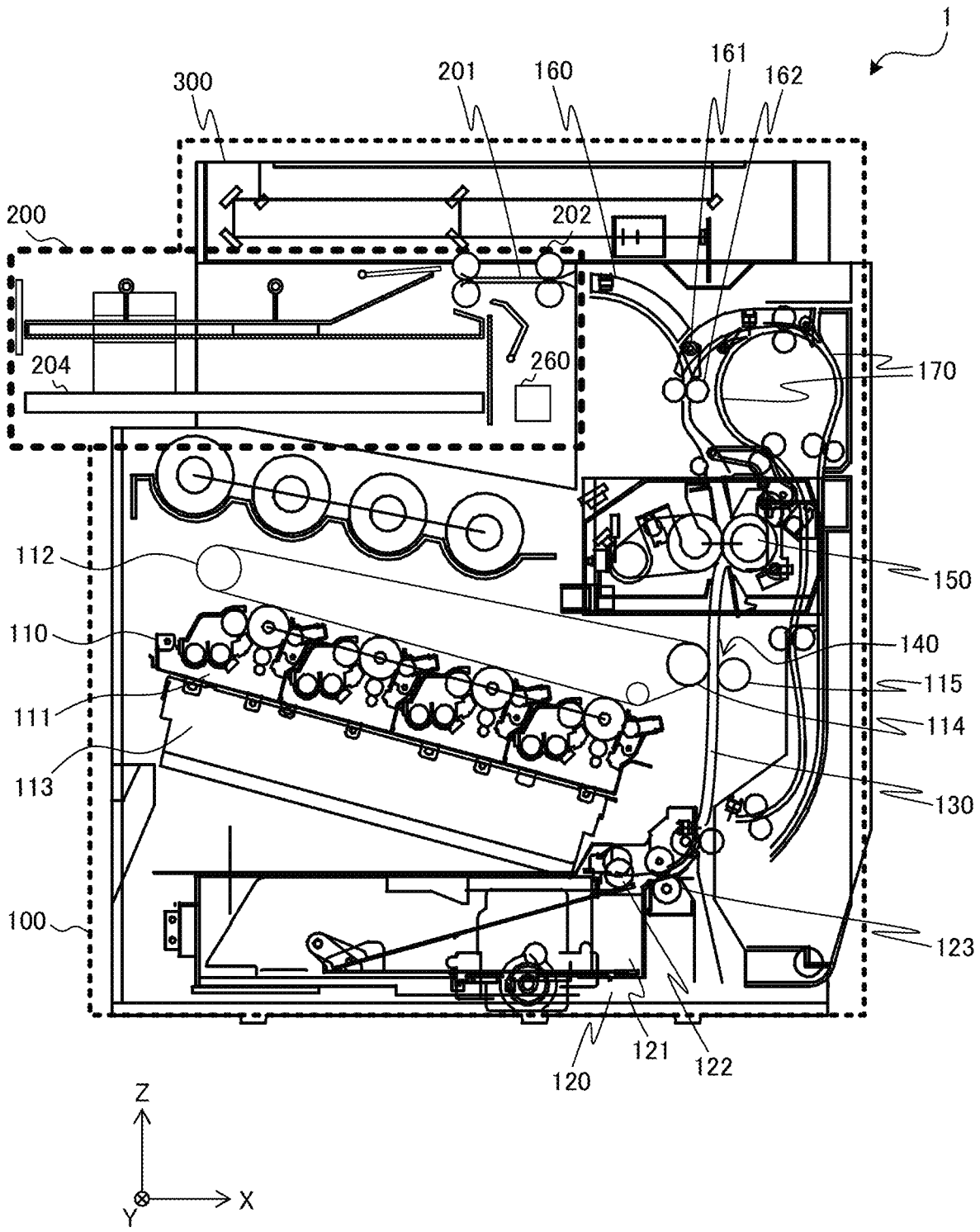
FIG. 1 is a schematic diagram of a configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a post-processing apparatus and an image forming system according to embodiments of the present disclosure are described with reference to the drawings. In the following descriptions, a paper medium is exemplified as an example of a sheet. However, for example, a sheet made of plastic, metal, or the like is also applicable.

Overall Configuration

FIG. 1 is a schematic diagram illustrating an image forming system 1 according to an embodiment of the present disclosure. The image forming system 1 includes an image forming apparatus 100, a post-processing apparatus 200, and an image reading apparatus 300. The post-processing apparatus 200 has a sheet stacking function, a sheet aligning function, and a sheet bundle binding function.

The image forming apparatus 100 is an indirect transfer tandem type image forming device that forms a color image, and functions as an image forming device that forms an image on a sheet P that serves as a medium. The image forming apparatus 100 includes an image forming device 110 in which image forming stations 111 for four colors are disposed, and an optical writing device 113 provided below and adjacent to the image forming device 110. The image forming apparatus 100 includes a sheet feeding device 120 and a sheet feeding conveyance path 130. The sheet feeding device 120 is provided below the image forming device 110. The sheet feeding conveyance path 130 guides the sheet P picked up by the sheet feeding device 120 to convey the sheet P to a secondary transfer device 140 and the fixing device 150. The image forming apparatus 100 includes a sheet discharge path 160 and duplex conveyance paths 170. The sheet discharge path 160 guides a sheet P on which an image has been fixed to convey the sheet P to the post-processing apparatus 200. The duplex conveyance paths 170 reverse (switch back) the sheet P on one side of which an image has been formed and guides the sheet P to the sheet feeding conveyance path 130 to form an image on the other side of the sheet P.

Each of the image forming stations 111 of the image forming device 110 includes a photoconductor drum for each color of Y, M, C, and K, a charger, a developing device, a primary transfer device, a cleaner, a discharger, and the like disposed along the outer circumference of each of the photoconductor drums. The image forming device 110 includes an intermediate transfer belt 112 to which images formed on the photoconductor drums are transferred by the primary transfer device, and the optical writing device 113 that writes an image on each of the photoconductor drums for each color. The optical writing device 113 is disposed below the image forming stations 111, and the intermediate transfer belt 112 is disposed above the image forming stations 111. The intermediate transfer belt 112 is rotatably supported by a plurality of support rollers. A support roller 114 as one of the support rollers faces a secondary transfer roller 115 as a secondary transfer device via the intermediate transfer belt 112 in the secondary transfer device 140, and secondarily transfers the image on the intermediate transfer belt 112 onto the surface of the sheet P. As such an image forming process, a known process other than the above may be adopted.

The sheet feeding device 120 includes a sheet feeding tray 121, pickup rollers 122, and sheet feeding conveyance rollers 123, and feeds the sheet P picked up from the sheet feeding tray 121 upward along the sheet feeding conveyance path 130. An image is transferred onto the fed sheet P by the secondary transfer device 140 and the sheet P is conveyed to the fixing device 150. The fixing device 150 includes fixing rollers and pressure rollers and heats and pressurizes the sheet P while the sheet P passes through nips between the fixing rollers and the pressure rollers to fix toner onto the sheet P.

The sheet discharge path 160 and the duplex conveyance paths 170 are provided downstream of the fixing device 150. A bifurcating claw 161 as a bifurcating member is switched to guide the sheep P to either one of the sheet discharge path 160 and the duplex conveyance paths 170. Thus, the conveyance path is selected between a case in which the sheet P is conveyed to the post-processing apparatus 200 and a case in which the sheet P is conveyed to the duplex conveyance paths 170. A pair of bifurcating conveyance rollers 162 is provided immediately upstream of the bifurcating claw 161 in the sheet conveyance direction to apply a conveyance force to the sheet P.

The post-processing apparatus 200 performs predetermined processing (for example, alignment) on the image-formed sheet P conveyed from the image forming apparatus 100, and stacks the image-formed sheet P on an ejection tray 204 located most downstream of the conveyance path. The detail of such processing is described later. In addition, the post-processing apparatus 200 performs a predetermined post-processing (for example, binding) on an end of a sheet bundle Pb formed by performing alignment on the image-formed sheets P conveyed from the image forming apparatus 100, and stacks the sheet bundle Pb on the ejection tray 204 located most downstream of the conveyance path. Note that when the image reading apparatus 300 is provided as illustrated in FIG. 1, the post-processing apparatus 200 is mounted in a space formed in a housing of the image forming apparatus 100 between the image forming apparatus 100 and the image reading apparatus 300, which is originally used as a discharge destination of the sheet P. Such a configuration can achieve both space saving and reduction of an installation area.

A controller 260 disposed in the post-processing apparatus 200 is a substrate including, for example, a central processing unit, a main storage device, an auxiliary storage device, and the like, and is a device that operates each piece of hardware by software processing. The controller 260 inputs detection signals indicating the presence or absence of the sheet P from sensors installed in each conveyance path, performs conveyance control of the sheet P in the post-processing apparatus 200 based on the detection signals, and performs operation control of units described later. Note that the image forming system 1 is controlled by a control unit provided in the image forming apparatus 100 communicating with the controller 260. However, instead of such a configuration, each unit in the post-processing apparatus 200 and each processing unit in the post-processing apparatus 200 may be collectively controlled.

The image reading apparatus 300 optically scans a document set on an exposure glass to read an image on a surface of the document. A known configuration and known functions may be employed as the configuration and functions of the image reading apparatus 300 itself.

The image forming apparatus 100 configured as described above generates image data to be used for writing based on document data read by the image reading apparatus 300 or print data transferred from an external personal computer or the like. Then, the optical writing device 113 performs optical writing on each of the photoconductor drums based on the image data, and the image formed for each color in each of the image forming stations 111 is sequentially transferred to the intermediate transfer belt 112. As a result, a color image in which images of four colors are superimposed is formed on the intermediate transfer belt 112. On the other hand, a sheet P is fed from the sheet feeding tray 121 in accordance with image formation. The sheet P is temporarily stopped at a position of a registration roller pair immediately before the secondary transfer device 140 and conveyed in synchronization with the timing of the leading end of the image on the intermediate transfer belt 112. Then, the sheep P is secondarily transferred by the secondary transfer device 140 and conveyed to the fixing device 150.

The sheet P on which the image has been fixed in the fixing device 150 is conveyed to the sheet discharge path 160 by the switching operation of the bifurcating claw 161 in a case of simplex printing and in a case of duplex printing after both sides of the sheet P have been printed, and is conveyed to the duplex conveyance path 170 in the case of duplex printing. The sheet P conveyed to the duplex conveyance path 170 is inverted and then conveyed again to the secondary transfer device 140, at which an image is formed on the other side of the sheet P, and the sheet P is conveyed to the sheet discharge path 160. The sheet P conveyed to the sheet discharge path 160 is conveyed to the post-processing apparatus 200, subjected to a predetermined processing such as binding by the post-processing apparatus 200, or discharged to the ejection tray 204 without processing.

Outline of Post-Processing Apparatus

Figure 2:
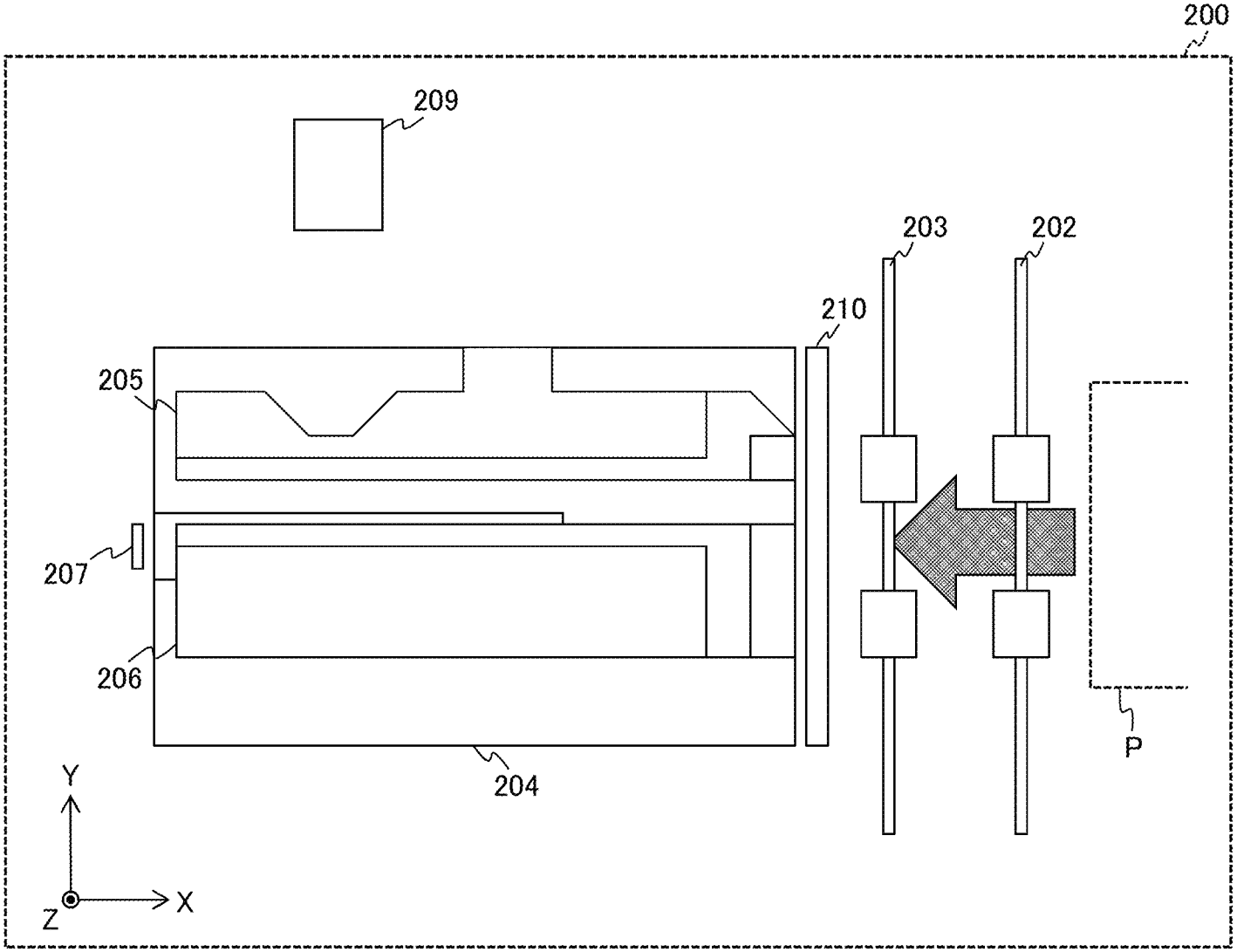
FIG. 2 is a schematic top view of a post-processing apparatus according to an embodiment of the present disclosure.
Figure 3:
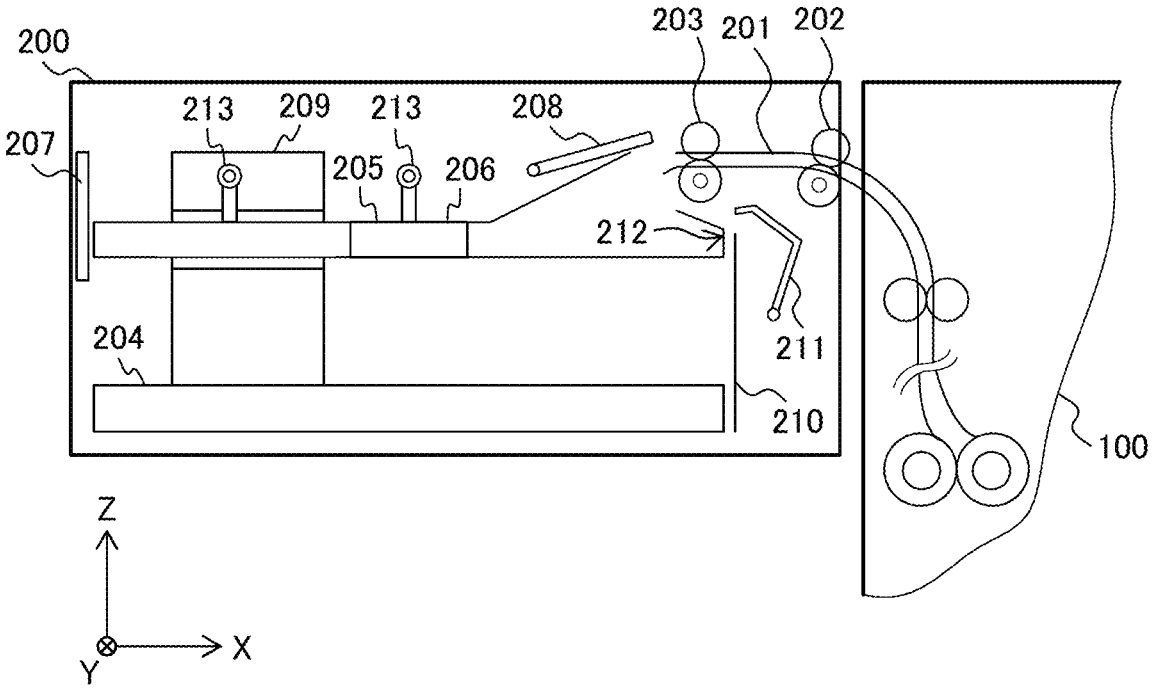
FIG. 3 is a schematic side view of a post-processing apparatus according to an embodiment of the present disclosure.

FIG. 2 is a schematic top view of the post-processing apparatus 200 according to the present embodiment. FIG. 3 is a schematic side view of the post-processing apparatus 200 according to the present embodiment. FIGS. 2 and 3 each illustrate a basic configuration applied to the embodiments of the present disclosure. The post-processing apparatus 200 includes, viewed from upstream in the conveyance direction of the sheets P, an inlet roller pair 202, a sheet surface detection feeler 211, a rear end reference fence 210, and a sheet discharge roller pair 203, jogger fences 205 and 206, a rear end guide 208, a leading end stopper 207, and the ejection tray 204. The jogger fences 205 and 206 as sheet aligning members align side edges (end portions) of the sheets P in the width direction of the sheet P to form an aligned sheet bundle Pb. The post-processing apparatus 200 includes a stapler 209 that serves as a binding device in addition to the configuration of the post-processing apparatus 200.

The jogger fence 205 on a back side corresponding to a right side in the conveyance direction of the sheet P and the jogger fence 206 on a front side corresponding to a left side in the conveyance direction of the sheet P are supported by a guide shaft 213 and provided to be movable in the axial direction of the guide shaft 213. Each of the jogger fences 205 and 206 includes a sheet rear end receiver 212. The sheet P is conveyed from a +X direction toward a −X direction illustrated in FIG. 2. The leading end stopper 207 as a sheet front end aligning member that aligns the front end of the sheet P is provided downstream in the conveyance direction of the sheet P.

A guide plate that receives the sheet P from the discharge conveyance path of the image forming apparatus 100 is disposed in a sheet receiving space of the post-processing apparatus 200. The inlet roller pair 202 is disposed on an extreme upstream of the guide plate in the conveyance direction of the sheet P. The sheet discharge roller pair 203 having a function of shifting the sheet P to the ejection tray 204 and discharging the sheet P is disposed on an extreme downstream in the conveyance direction of the sheet P.

The inlet roller pair 202 and the sheet discharge roller pair 203 are rotated by an inlet motor to convey the sheet P in the post-processing apparatus 200 along the guide plates.

Each of the jogger fences 205 and 206 includes a stacker that stacks ends of the sheet P in the width direction (Y direction) of the sheet P discharged from the sheet discharge roller pair 203 and an aligning unit that contacts side ends of the sheet P in the width direction of the stacked sheet P to align the sheet P in the width direction, and functions also as a stacker.

The sheet discharge operation of the post-processing apparatus 200 includes three modes such as a shift mode, a straight ejection mode, and a stapling mode. In the shift mode, the sheet P shifts to a different position for each job and is ejected. In the straight ejection mode, the sheet P is ejected as it is. In the stapling mode, a plurality of sheets P is bound as a sheet bundle Pb and the sheet bundle Pb is ejected. The operations in the shift mode and the straight ejection mode are the same as operations of the conventional technology. Accordingly, the configuration and the operation of each unit in the stapling mode are described below.

The operations in the stapling mode in the post-processing apparatus 200 are described below. The stapling mode is an operation mode in which the stapler 209 binds an end of the sheet bundle Pb. Accordingly, after the alignment is performed in the post-processing apparatus 200, the binding is performed by the stapler 209. As will be described later, the alignment is performed by the post-processing apparatus 200 and then the binding is performed by the post-processing apparatus 200 in a series of operations in the stapling mode.

Figure 4:
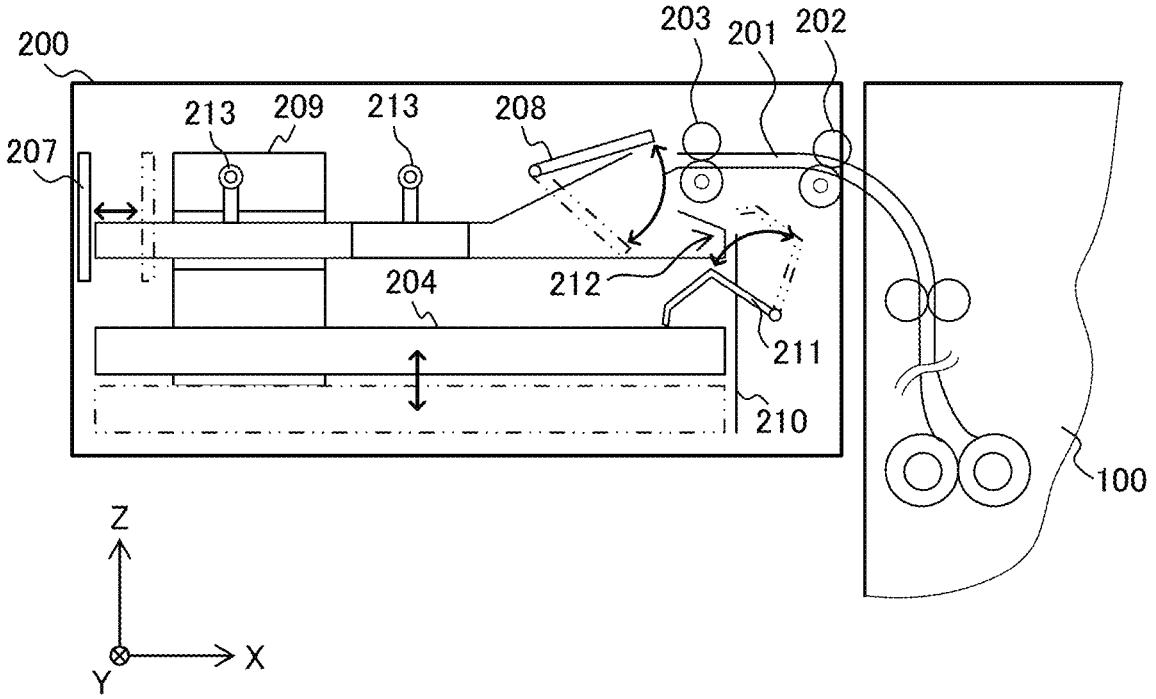
FIG. 4 is a schematic side view of a post-processing apparatus at the time when the operations in a stapling mode are performed according to a first embodiment of the present disclosure.
Figure 5:
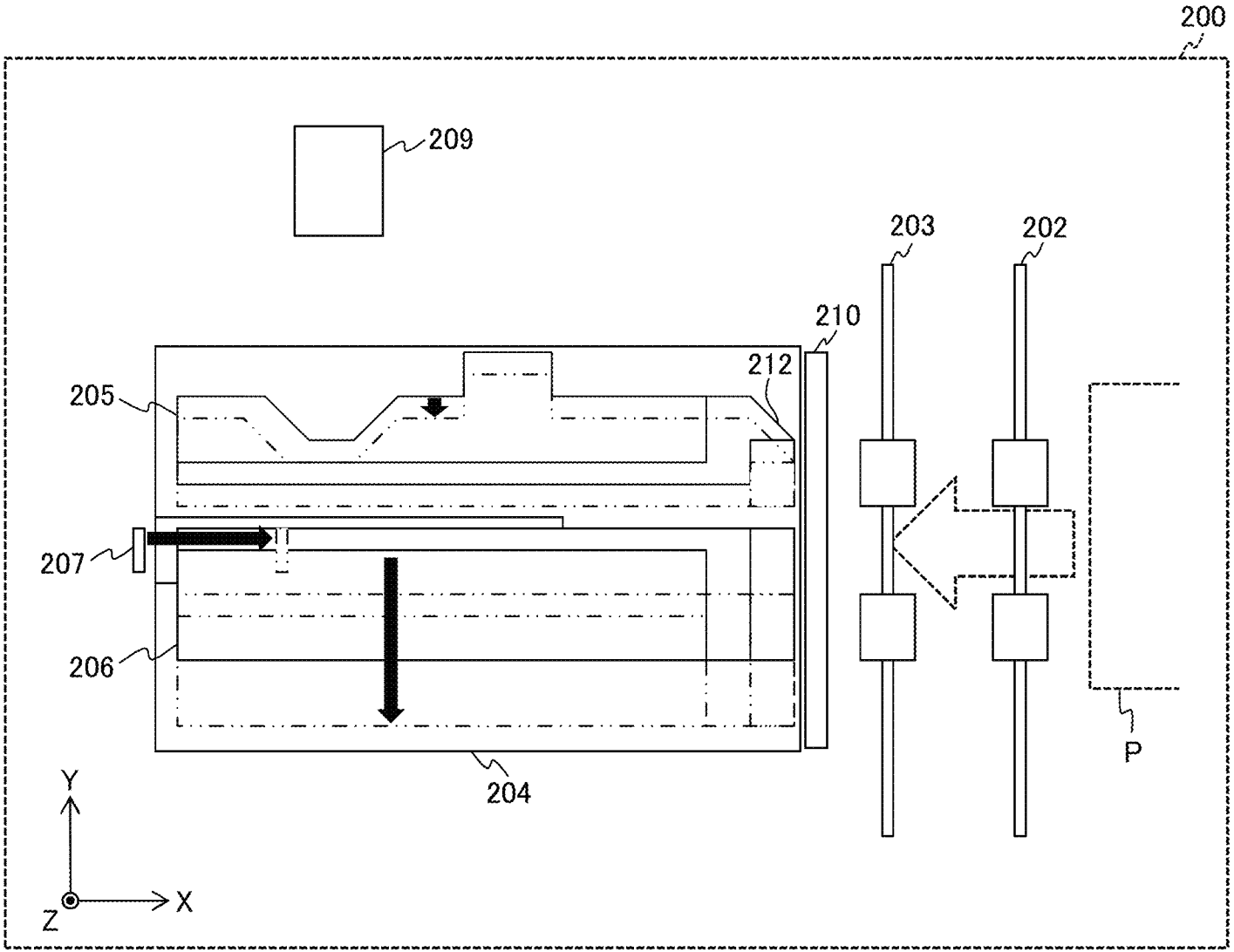
FIG. 5 is a schematic top view of a post-processing apparatus at the time when the operations in a stapling mode are performed according to the first embodiment of the present disclosure.

FIG. 4 is a schematic side view of the post-processing apparatus 200 in which the operations in the stapling mode are performed, according to the present embodiment. FIG. 5 is a schematic top view of the post-processing apparatus 200 in which the operations are performed, according to the present embodiment. In the stapling mode, as illustrated in FIGS. 4 and 5, the ejection tray 204, the jogger fences 205 and 206, and the leading end stopper 207 move to sheet receiving positions in the post-processing apparatus 200. At this time, the ejection tray 204 moves to a position indicated by a dotted line in FIGS. 4 and 5, that is, a downward position by 30 mm away from bottom surfaces of the jogger fences 205 and 206. Further, the jogger fences 205 and 206 are moved to the sheet receiving positions, which are positions about 7 mm outside with respect to edges of the sheet P to be discharged. Note that the sheet receiving position of the leading end stopper 207 is preferably set to a position upstream of the conveyance direction of the jogger fences 205 and 206, which corresponds to the length of the sheet P added by 25 mm from the sheet rear end receiver 212.

When the movement of the ejection tray 204 is completed, the sheet surface detection feeler 211 is retracted to an upstream side of the rear end reference fence 210 in the conveyance direction. The sheet surface detection feeler 211 comes into contact with the upper surface of an uppermost sheet P placed on the ejection tray 204, and turns on a sheet surface detection sensor when the position of the upper surface of the uppermost sheet P is smaller than 30 mm from the bottom surfaces of the jogger fences 205 and 206, and turns the sheet surface detection sensor off when the position of the upper surface of the uppermost sheet P is larger than the 30 mm. The on and off state of the position detection sensor is switched depending on the position of the sheet surface detection feeler 211. Accordingly, the stacking height of the sheets P is detected.

Further, at the same time when the ejection tray 204, the jogger fences 205 and 206, and the leading end stopper 207 move, the stapler 209 is moved to a predetermined binding position by a binding unit movement motor.

After the ejection tray 204, the jogger fences 205 and 206, and the leading end stopper 207 are moved to the sheet receiving position and the movement is complete, the sheet P is discharged from the sheet discharge roller pair 203 to the jogger fences 205 and 206, and the rear end guide 208 waiting at an upper portion of the ejection tray 204 is lowered toward the ejection tray 204 at the timing when the rear end of the sheet P comes out of the sheet discharge roller pair 203. The above-described operation allows the next sheet P to be discharged without the rear end of the sheet P falling from the sheet discharge roller pair 203 and the occurrence of jamming can be prevented.

Figure 6:
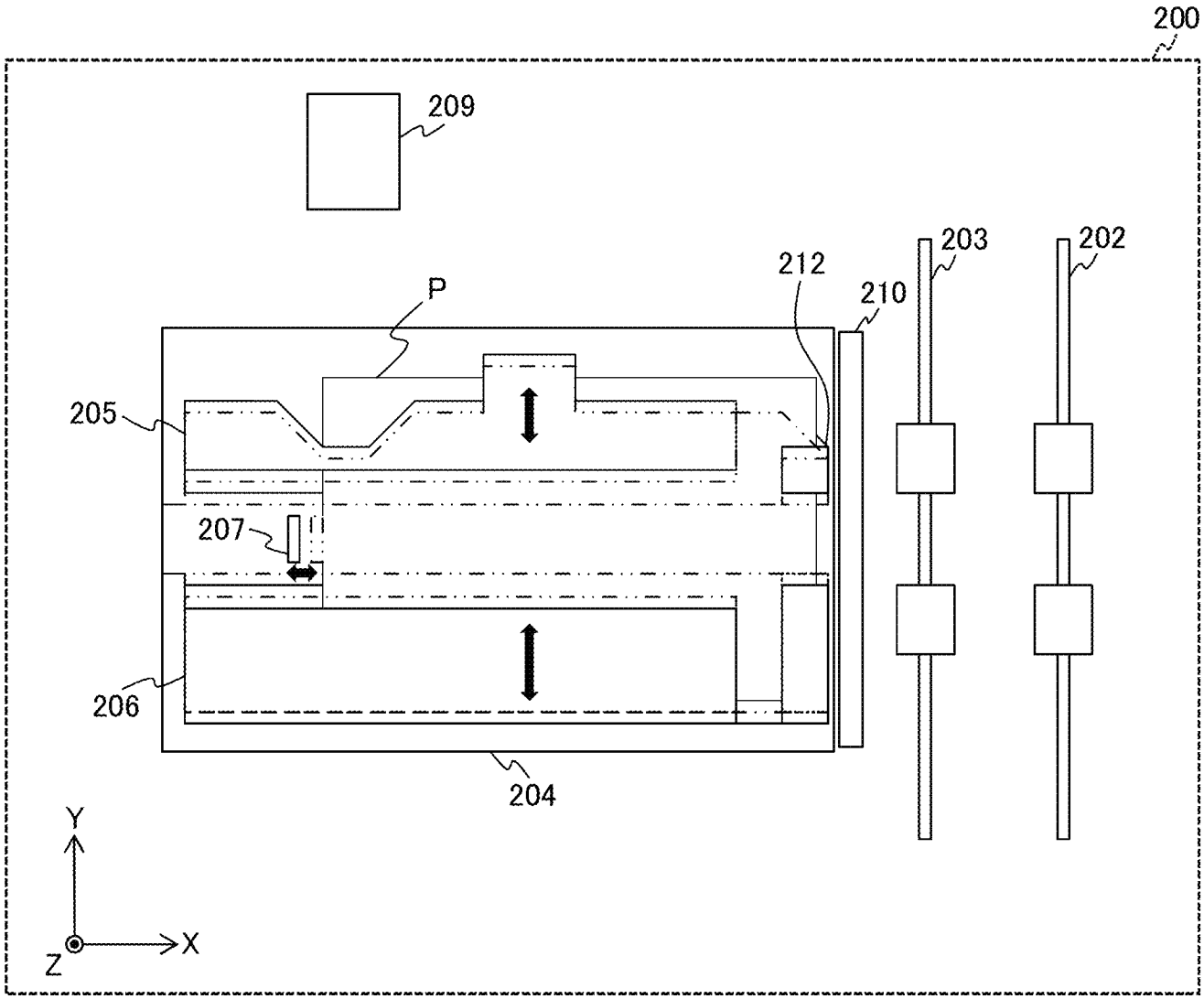
FIG. 6 is another schematic top view of a post-processing apparatus at the time when the operations in a stapling mode are performed according to the first embodiment of the present disclosure.

After the rear end guide 208 is lowered, as illustrated in FIG. 6, the leading end stopper 207 moves from the standby position (sheet receiving position) to upstream in the conveyance direction. Then, the leading end stopper 207 moves to an end aligning position indicated by the solid line in FIG. 6 with respect to the sheet P received by the jogger fences 205 and 206. As a result, the leading end and the rear end of the sheet P in the conveyance direction are sandwiched between the leading end stopper 207 and the sheet rear end receiver 212. Accordingly, the positions of the leading ends and the rear ends of the sheet P in the conveyance direction are aligned. At the same time when the leading ends and the rear ends of the sheet P in the conveying direction are aligned, the jogger fences 205 and 206 sandwich the sheet P in the width direction, thereby aligning side ends of the sheet P. After the alignment of the sheet P is completed, the jogger fences 205 and 206, the leading end stopper 207, and the rear end guide 208 move to the standby position again.

Figure 7:
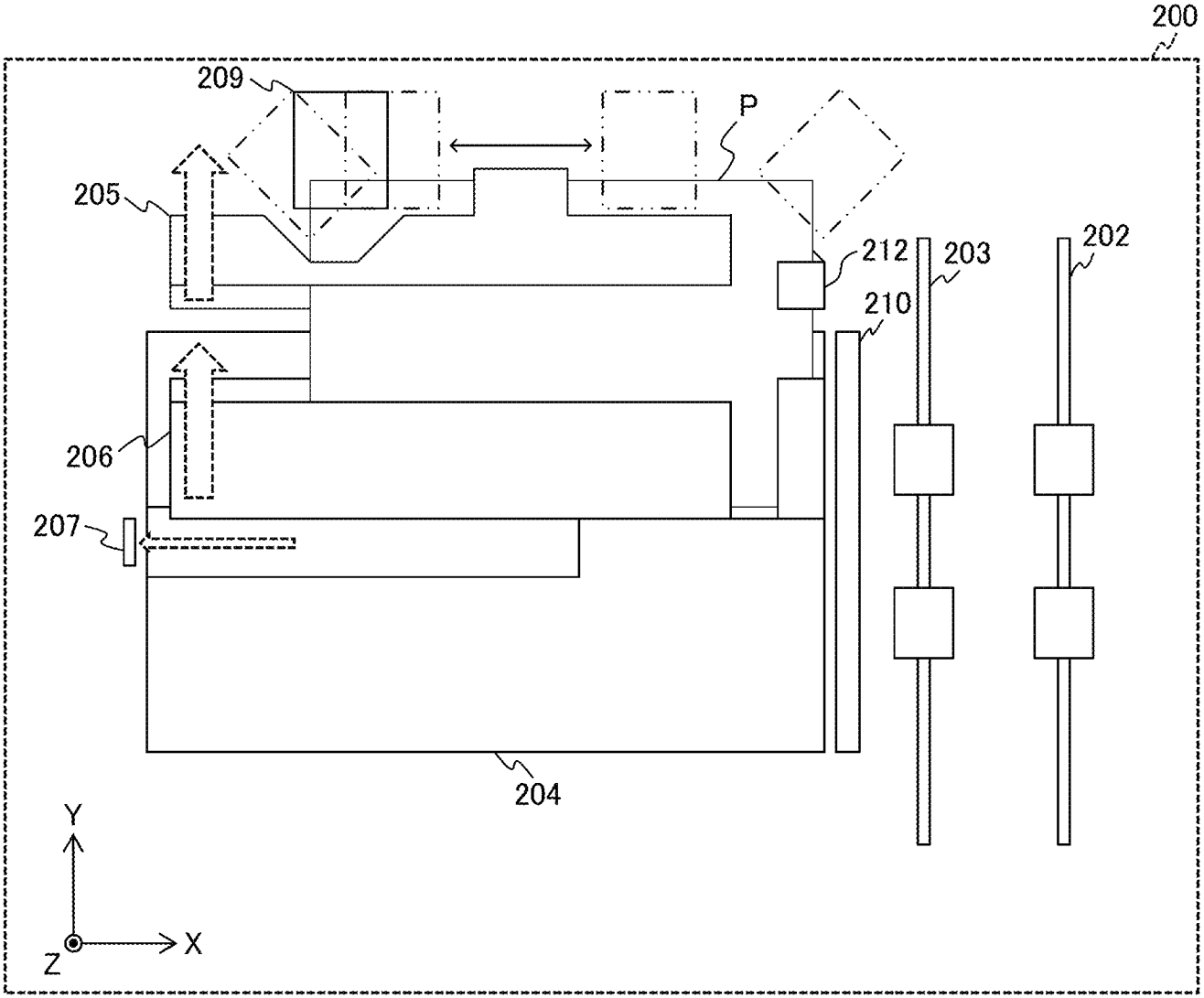
FIG. 7 is a schematic top view of a post-processing apparatus at the time when a stapler moves to a stapling position, according to the first embodiment of the present disclosure.

The above alignment operation is repeated from the first sheet P to the last sheet P. When the alignment operation of the last sheet P is completed, the leading end stopper 207 is retracted from between the jogger fences 205 and 206 (sheet receiving position). Then, the jogger fences 205 and 206 move the stapler 209, which is disposed on a rear side as illustrated in FIG. 7, to the binding position corresponding to a processing region (processing space) while relatively holding the sandwiching position of the sheet P in the width direction. The above-described movement of the jogger fences 205 and 206 allows the sheet bundle Pb whose side ends are aligned to be moved to the binding position. After the jogger fences 205 and 206 have moved to the binding position, binding is performed by the stapler 209.

Figure 8:
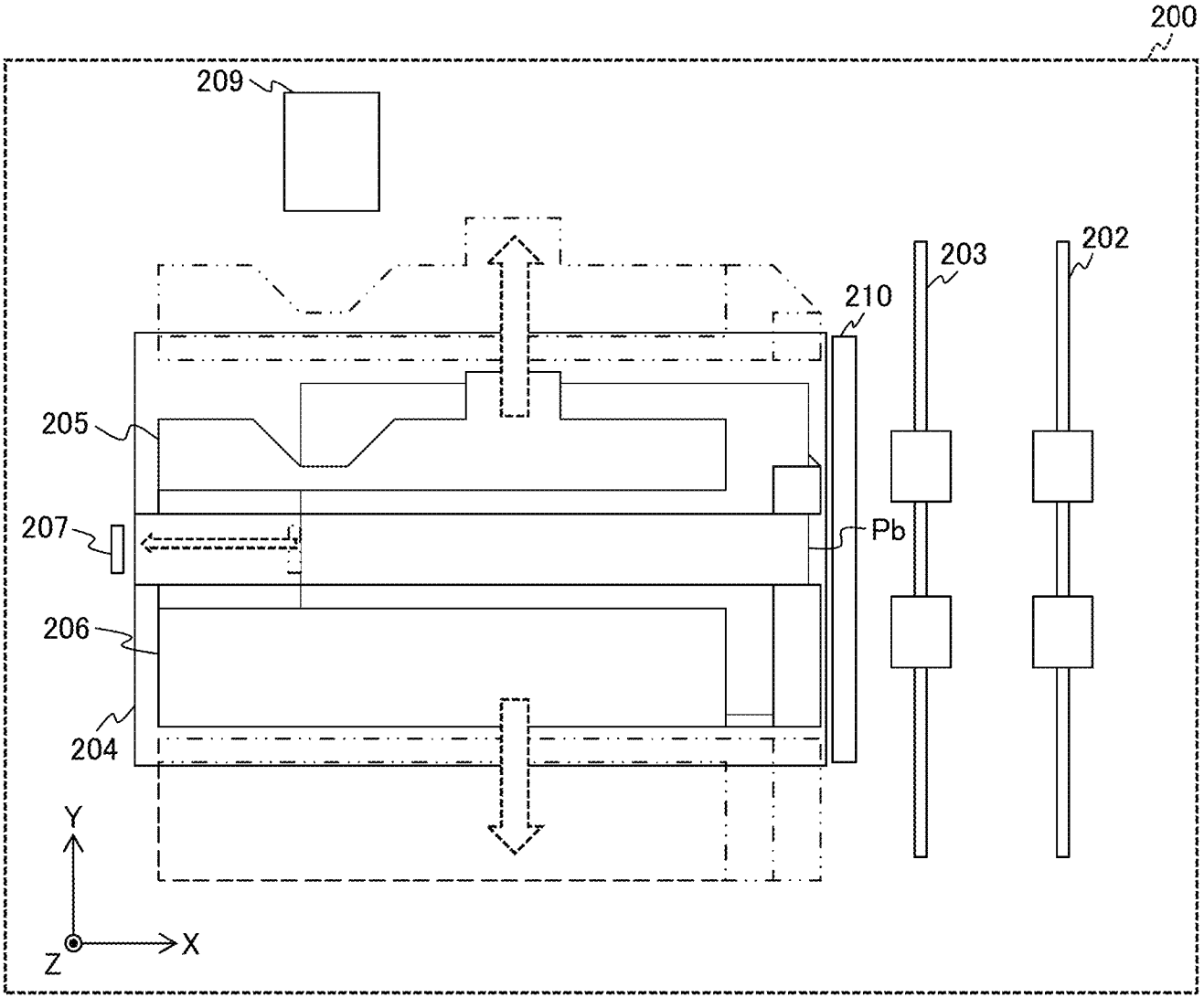
FIG. 8 is a schematic top view of a post-processing apparatus at the time when a bundle of sheets that have been bound is dropped according to the first embodiment of the present disclosure.

After the completion of the binding by the stapler 209, the jogger fences 205 and 206 are moved to positions at which the alignment of the sheets P in the width direction has been performed. In addition, the leading end stopper 207 is also moved to the position at which the sheets P are aligned in the conveyance direction. Subsequently, as indicated by solid lines in FIG. 8, after the jogger fences 205 and 206 and the leading end stopper 207 have been moved, the jogger fences 205 and 206 are moved outward so as to be separated from each other. This movement causes the sheet bundle Pb to fall onto the ejection tray 204 positioned below the jogger fences 205 and 206. After the sheet bundle Pb falls onto the ejection tray 204, the jogger fences 205 and 206 and the leading end stopper 207 move to the sheet receiving position to receive the sheet P conveyed next.

After the sheet P is dropped from the jogger fences 205 and 206, the sheet surface detection feeler 211 returns from the retracted position to detect the height of the sheet bundle Pb stacked on the ejection tray 204. In accordance with the detection result, the ejection tray 204 is lowered to a position corresponding to the thickness of the stacked sheet bundle Pb. The lowering operation of the ejection tray 204 allows the distance from the bottom surfaces of the jogger fences 205 and 206 to the uppermost sheet P on the ejection tray 204 to be kept constant. Thus, a large number of sheets P can be stacked. Note that when all print jobs are completed, the ejection tray 204 is lowered to the lowermost position (initial position).

Basic Configuration of Stapler 209

Figure 9A:
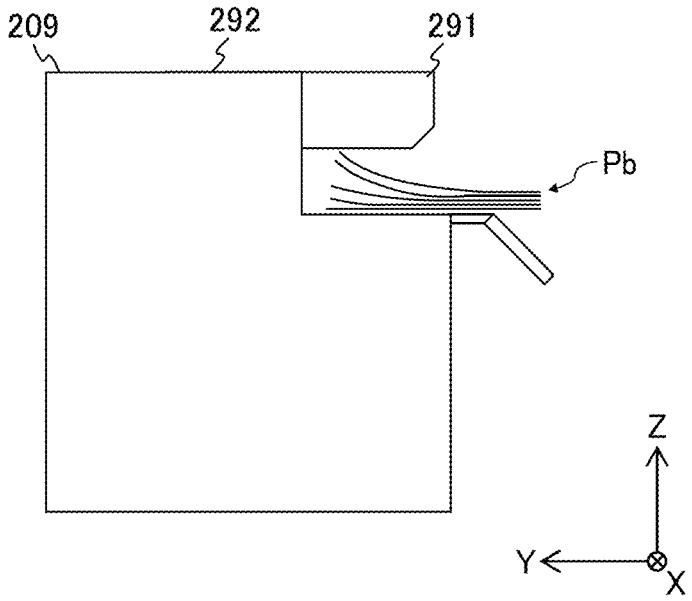
FIGS. 9A and 9B are diagrams each illustrating a basic configuration of a stapler of a post-processing apparatus according to the first embodiment of the present disclosure.
Figure 9B:
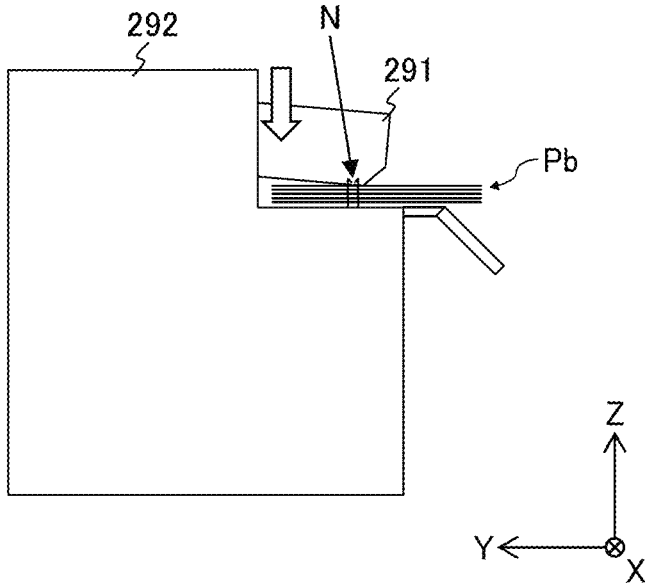

FIG. 9 illustrates a basic configuration of the stapler 209 according to the present embodiment. The stapler 209 includes a clincher 291 and a driver 292. The space or in which the clincher 291 operates to press staples N protruding from the driver 292 corresponds to the processing region in which binding is performed. After the side ends of the sheet bundle Pb are moved and has entered the processing region as the binding position by the jogger fences 205 and 206, the driver 292 causes the staples N to protrude and penetrate an end of the sheet bundle Pb. Subsequently, the clincher 291 presses and bends the ends (leading ends) of the staples N that have penetrated the sheet bundle Pb. The binding of the sheet bundle Pb is executed as described above. The operation of the clincher 291 that moves up and down so as to bend and fix the staples N on the sheet bundle Pb and the operation of the driver 292 that causes the staples N to protrude and penetrate the sheet bundle Pb are performed by a stapler driving source controlled by the controller 260.

First Embodiment

Figure 10A:
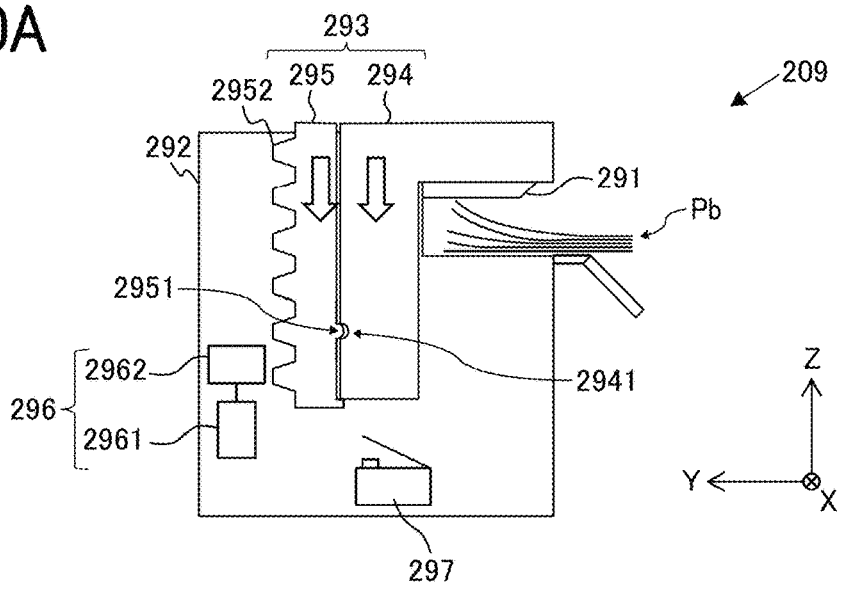
FIGS. 10A, 10B, and 10C are diagrams each illustrating a configuration of a stapler of a post-processing apparatus according to the first embodiment of the present disclosure.
Figure 10B:
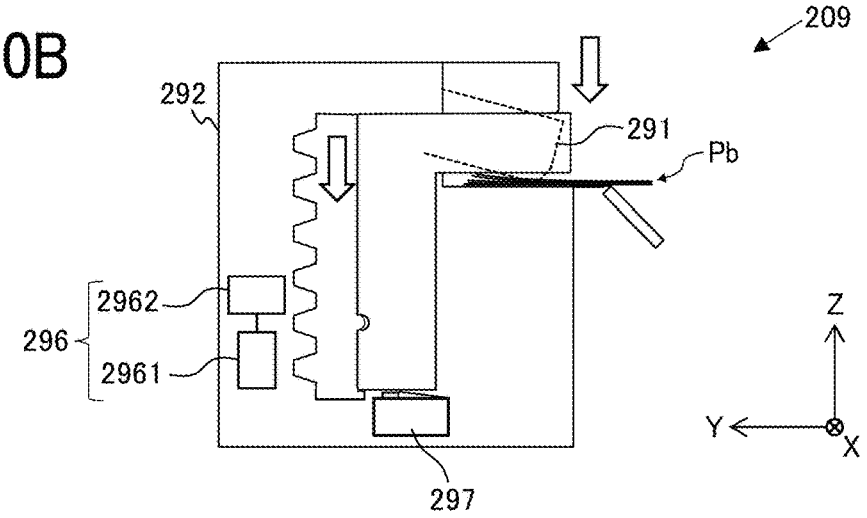
Figure 10C:
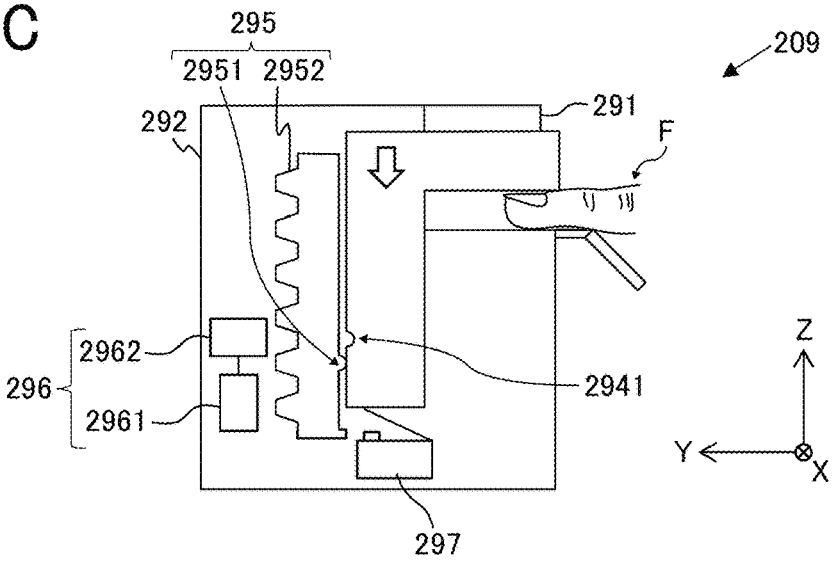

FIGS. 10A, 10B, and 10C are diagrams each illustrating the stapler 209 according to a first embodiment of the present disclosure. FIG. 10A illustrates the stapler 209 in a state in which the sheet bundle Pb has moved (entered) into the processing region, and illustrates a pre-execution stage of binding process. FIG. 10B illustrates the stapler 209 in a stage in which binding is performed on the sheet bundle Pb in the processing region. FIG. 10C illustrates the stapler 209 in an avoidance stage that occurs when the binding is executed in a state in which the sheet bundle Pb is present in the processing region and a foreign object F (for example, a part of the user's finger) has entered the processing region.

As illustrated in FIGS. 10A, 10B, and 10C, the stapler 209 includes the clincher 291, the driver 292, a shutter 293 as a closing member, a shutter driver 296 as a driver, and a changeover switch 297 as a changeover switch. Since the clincher 291 and the driver 292 have already been described, the details thereof is omitted.

The shutter 293 includes an avoidance operation portion 294 and a drive coupler 295. The avoidance operation portion 294 closes an opening serving as an entrance through which the sheet bundle Pb is moved to a space (binding position) in which the clincher 291 presses the staples to perform binding, and avoids a closing operation of the opening when the movement of the sheet bundle Pb is prevented when the sheet bundle Pb moves to a closing position. The drive coupler 295 transmits drive force to move the avoidance operation portion 294 to the closing position. The closing position is a position at which the avoidance operation portion 294 blocks the space including the binding position from outside to prevent an object (foreign object) other than the sheet bundle Pb from entering through the opening.

The avoidance operation portion 294 includes a coupling hole 2941 as a coupler for coupling with the drive coupler 295. The drive coupler 295 includes a protrusion 2951 as a coupling portion to be fitted into the coupling hole 2941. The avoidance operation portion 294 moves to the closing position in conjunction with the movement of the drive coupler 295 when the drive coupler 295 is moved by the driving force caused by the shutter driver 296 in a state in which the protrusion 2951 as the coupler and the coupling hole 2941 remain in the fitted state (coupling state).

The drive coupler 295 includes a rack gear 2952 as a driving force receiver for receiving the driving force caused by the shutter driver 296, in addition to the protrusion 2951 for transmitting the driving force to the avoidance operation portion 294. The protrusion 2951 has a hemispherical shape and is formed so as to be fitted into the coupling hole 2941 of the avoidance operation portion 294 with a fitting degree such that the fitted state (coupling state) is released when the drive coupler 295 continues to move in a state in which the movement of the avoidance operation portion 294 is prevented.

The shutter driver 296 includes a closing drive motor 2961 as a drive source and a pinion gear 2962 as a closing drive gear fixed to a drive shaft of the closing drive motor 2961. The pinion gear 2962 meshes with the rack gear 2952 and transmits a driving force to move the drive coupler 295 in a vertical direction when the closing drive motor 2961 is driven.

The changeover switch 297 as a changeover device is disposed at a position at which an operation of turning on the changeover switch 297 is performed when the avoidance operation portion 294 is moved to the closing position. The changeover switch 297 opens and closes a power supply circuit that supplies operating power to the stapler 209. When the changeover switch 297 is turned on, the "executable state" in which the binding operation by the stapler 209 is executed is set.

Operation of Shutter 293 (Including Avoidance Operation)

Next, the operation of the stapler 209 including the shutter 293 is described. When the sheet bundle Pb is moved to the binding position, the controller 260 first drives the closing drive motor 2961 to rotate the pinion gear 2962. Thus, the drive coupler 295 is moved toward the changeover switch 297. The avoidance operation portion 294 moves toward the closing position (FIG. 10A) in conjunction with the movement of the drive coupler 295.

When the avoidance operation portion 294 moves to the closing position, the changeover switch 297 installed in the movement direction is operated (pressed) by the avoidance operation portion 294. When the changeover switch 297 is pressed, the power supply circuit to the driver 292 of the stapler 209 is closed, and the driver 292 and the clincher 291 that serves as a binding device are switched to an executable state in which the binding operation can be executed. Thus, the staples N are protruded and the pressing operation of the staples N by the clincher 291 is performed. That is, operating the changeover switch 297 allows the drive source included in the driver 292 to be operable and the clincher 291 also to be operable.

At this time, the opening is closed by the avoidance operation portion 294 and only the sheet bundle Pb is present at the binding position. That is, when the stapler 209 is in a state in which the binding operation can be performed by the movement of the avoidance operation portion 294, the opening is blocked from the outside by the avoidance operation portion 294 and the entry of a foreign object F is prevented. Thus, the foreign object F being caught in the avoidance operation portion 294 and the foreign object F entering the binding position when the binding operation is executable can be prevented.

On the other hand, when the closing drive motor 2961 is driven by the controller 260 to start the movement of the drive coupler 295, and the movement of the avoidance operation portion 294 is prevented in the middle of the movement of the avoidance operation portion 294 toward the closing position in conjunction with the movement, the coupling state between drive coupler 295 and the avoidance operation portion 294 is released. For example, when there is the foreign object F at the entrance or when the foreign object F has entered the binding position, the foreign object F is caught between the avoidance operation portion 294 and the driver 292. In such a state, the avoidance operation portion 294 cannot move to the closing position, and the movement of the avoidance operation portion 294 is prevented.

Even if the movement of the avoidance operation portion 294 is blocked by the foreign object F, the drive coupler 295 continues to move by the driving force of the closing drive motor 2961. Thus, the protrusion 2951 is disengaged from the coupling hole 2941 and the fitted state (coupling state) is released. When the coupling state of the avoidance operation portion 294 with the drive coupler 295 is released, the avoidance operation portion 294 loses the driving force and stops. In this case, the avoidance operation portion 294 stops without reaching the closing position.

When the avoidance operation portion 294 stops without moving to the closing position, as described above, the changeover switch 297 is not operated and the binding process is disabled. That is, the binding process is avoided by the avoidance operation portion 294.

The stapler 209 according to the present embodiment can detect the difference between the thickness of the sheet bundle Pb having the predetermined number of sheets to be bound and the thickness of the foreign object F. Accordingly, when the gap between the shutter 293 and the driver 292 is smaller than the thickness of the sheet bundle Pb having the predetermined number of sheets to be bound, the changeover switch 297 is operated to set the binding process in the executable state.

In the present embodiment, the predetermined number of sheets to be bound is, for example, the maximum number of sheets of plain paper to be bound, and the maximum number of sheets to be bound may be increased or decreased depending on the thickness of the paper to be used. When the gap is larger than the thickness of the predetermined number of sheets to be bound, power is not supplied to the driver 292 of the stapler 209. Therefore, even if the sheet bundle Pb is removed when the sheet bundle Pb is bound and the foreign object F enters the empty space, the power supply to the driver 292 can be kept cut off.

As illustrated in FIG. 10A, when the side ends of the sheets P constituting the sheet bundle Pb are largely bent, preferably, the shutter 293 stands by in a gap smaller than the gap of the opening when the sheet bundle Pb is made to enter from the opening and is moved to the binding position. This is to prevent the sheets P from being caught by a step between the shutter 293 and the driver 292.

When the sheet bundle Pb is bound, the shutter 293 is in a closed state in which the opening is closed. In this closed state, the shutter 293 closes the entrance until the thickness of a predetermined number of sheets to be bound is reached. However, the stapler 209 also performs the binding operation on the sheet bundle Pb of which the number of sheets is equal to or less than the predetermined number of sheets to be bound. Accordingly, the binding operation by the driver 292 and the clincher 291 can be performed even when the gap formed at the entrance closed by the shutter 293 is smaller than the thickness of the predetermined number of sheets to be bound.

Note that the drive coupler 295 only needs to vary the gap (opening amount of the opening) of the shutter 293 and the driver configuration to move the shutter 293 is not limited to the combination of the closing drive motor 2961 and the rack and pinion gear mechanism. For example, belt transmission or an electromagnetic solenoid may be used for the driver configuration.

The stapler 209 according to the present embodiment can switch the position of the shutter 293 between the position in which the opening for allowing the sheet bundle Pb to enter and exit the binding position is widely opened and the position in which the opening is closed to prevent the foreign object F from entering (closing position). Setting the shutter 293 to the widely opened position by the above-described position switching operation allows to reduce the conveyance resistance when the sheet bundle Pb whose side ends are largely bent enters the opening.

The fitting force between the protrusion 2951 and the coupling hole 2941 is set to be stronger than the force with which the avoidance operation portion 294 presses the changeover switch 297. In addition, the fitting force between the protrusion 2951 and the coupling hole 2941 is set to be weaker than the force for moving the drive coupler 295 by the shutter driver 296 when the movement of the avoidance operation portion 294 is blocked and stopped. Therefore, when the movement of the avoidance operation portion 294 to the closing position is blocked and stopped, the transmission of the driving force to the avoidance operation portion 294 is blocked and the avoidance operation portion 294 stops in a state in which the foreign object F is sandwiched by its own weight. At this time, the force applied to the foreign object F is small. Accordingly, the foreign object F can be easily pulled out and removed.

Return Operation

Next, as illustrated in FIG. 10C, when the coupling state between the avoidance operation portion 294 and the drive coupler 295 is released, that is, when the fitting between the coupling hole 2941 and the protrusion 2951 is released, an operation to return the state to the fitted state is described with reference to FIGS. 11A and 11B.

Figure 11A:
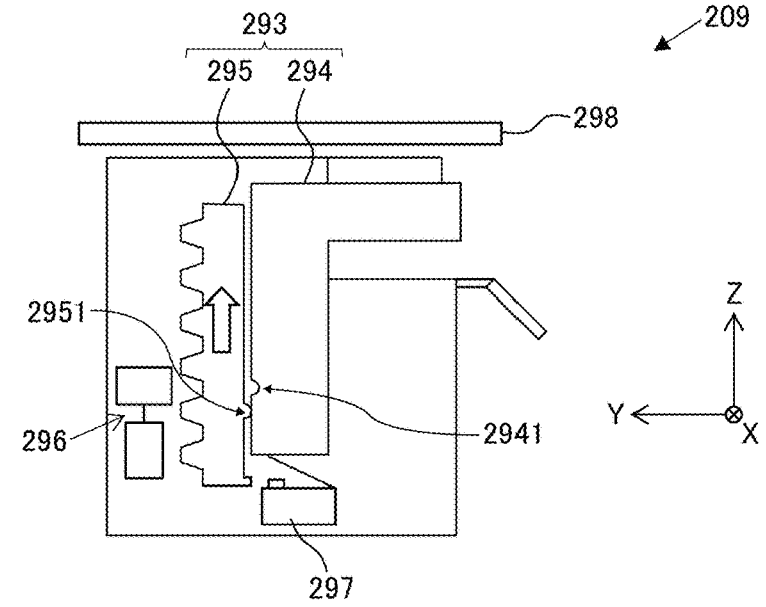
FIGS. 11A, 11B, and 11C are diagrams each illustrating a configuration of a stapler of a post-processing apparatus according to the first embodiment of the present disclosure.
Figure 11B:
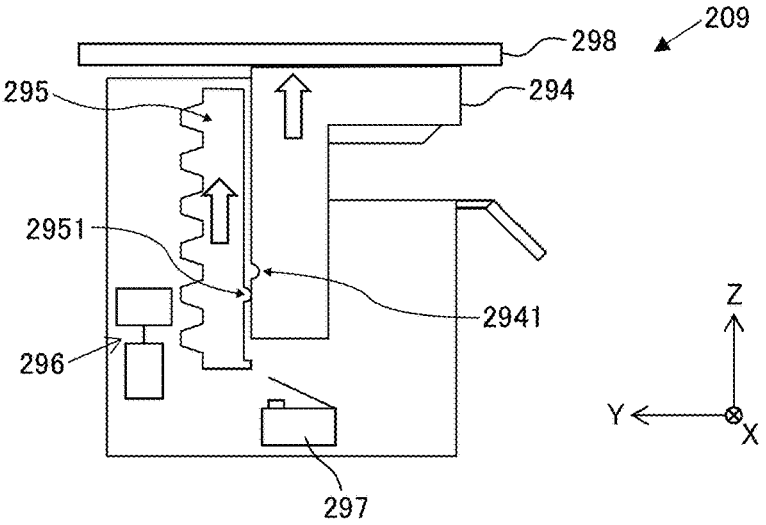

As illustrated in FIG. 11A, when the state in which the coupling state between the avoidance operation portion 294 and the drive coupler 295 is released is returned to the state illustrated in FIG. 10A, the user may manually return the protrusion 2951 which is detached from the coupling hole 2941.

Figure 11C:
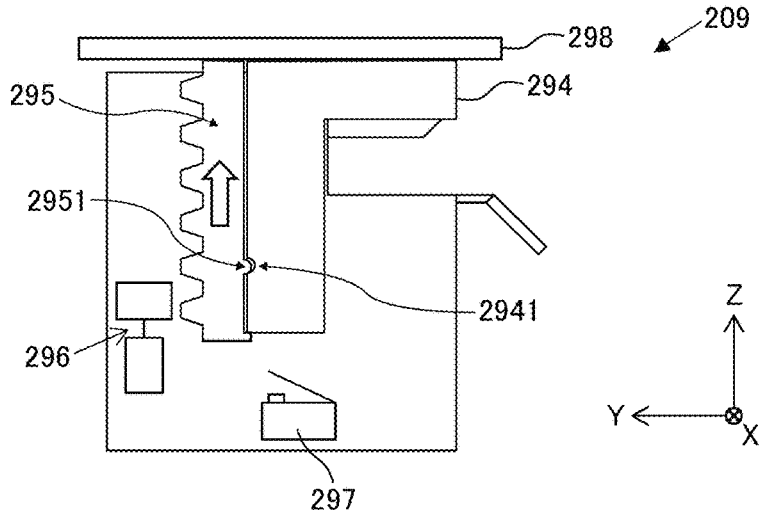

Alternatively, the shutter driver 296 may be driven to move the shutter 293 so as to open the opening, thereby fitting the protrusion 2951 into the coupling hole 2941. In such a case, as illustrated in FIG. 11, a wall 298 disposed above the stapler 209 is used. When the controller 260 operates the shutter driver 296 to move the drive coupler 295 upward from the state of FIG. 11A, the avoidance operation portion 294 also moves upward due to friction between the protrusion 2951 and the avoidance operation portion 294. At this time, as illustrated in FIG. 11B, the avoidance operation portion 294 located above the drive coupler 295 first comes into contact with the wall 298. After that, when the shutter driver 296 is driven, the drive coupler 295 moves upward while the avoidance operation portion 294 remains in contact with the wall 298 and stopped. As a result, as illustrated in FIG. 11C, the protrusion 2951 is fitted into the coupling hole 2941 and can be returned to the original state.

Note that the method of coupling the avoidance operation portion 294 and the drive coupler 295 is not limited to the method of fitting the coupling hole 2941 and the protrusion 2951 as described above. For example, power may be transmitted using frictional power transmission. In this case, the friction is set to be larger than the force for pressing down the changeover switch 297, and the driving force for pressing down the avoidance operation portion 294 is set to be larger than the force for sliding the avoidance operation portion 294 with respect to the drive coupler 295.

Further, the movement of the drive coupler 295 that moves in a predetermined direction by the driving force caused by the shutter driver 296 is not limited to linear movement and may be rotational movement. Similarly, the movement of the avoidance operation portion 294 is not limited to the linear movement, and may be a rotational movement as long as the avoidance operation portion 294 moves to the closing position to bring the entrance into the closing position.

Operation Procedure in Stapling Mode

Figure 12A:
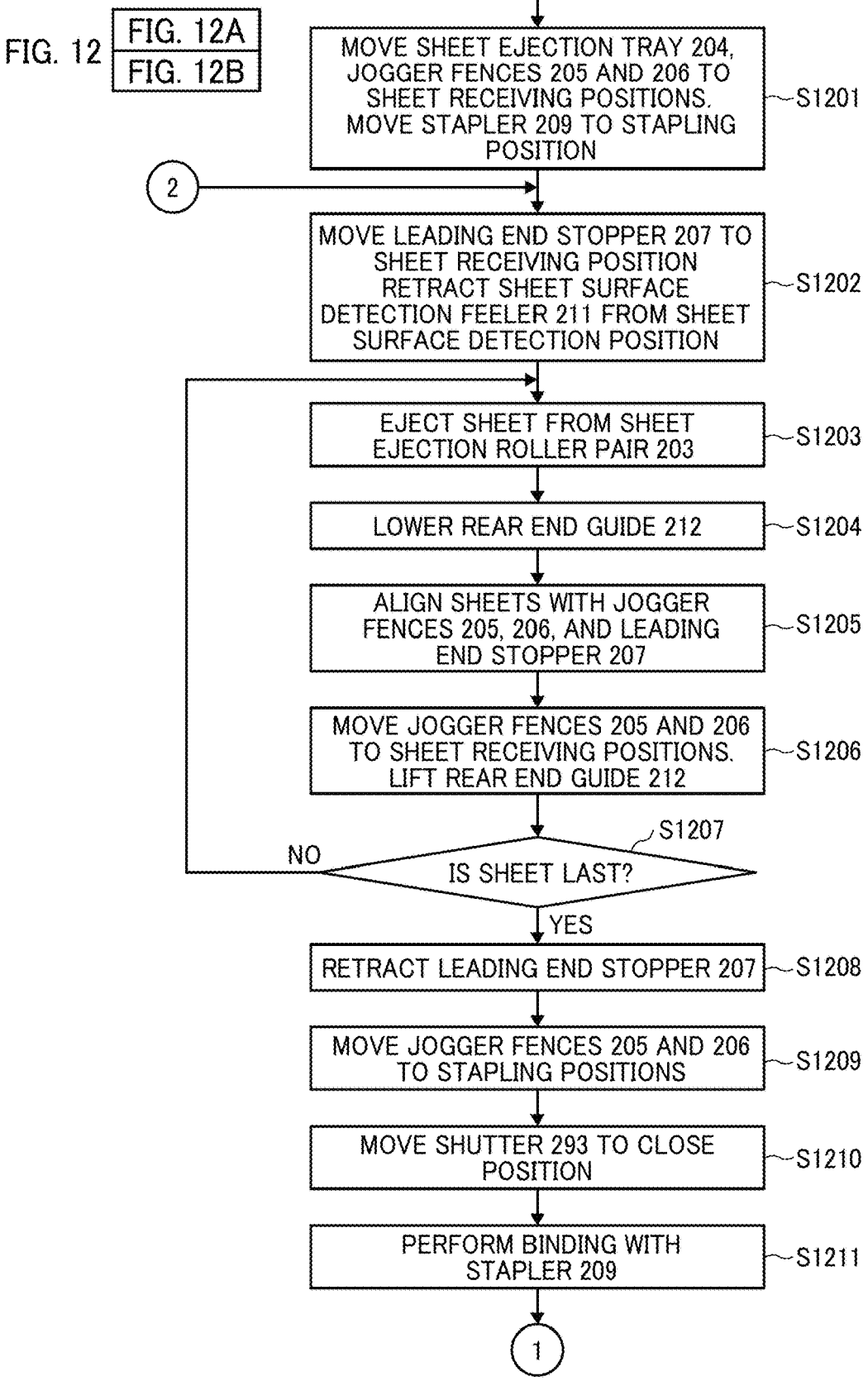
FIGS. 12A and 12B is a flowchart of a series of operations performed at a stapler in a stapling mode, according to the first embodiment of the present disclosure.
Figure 12B:
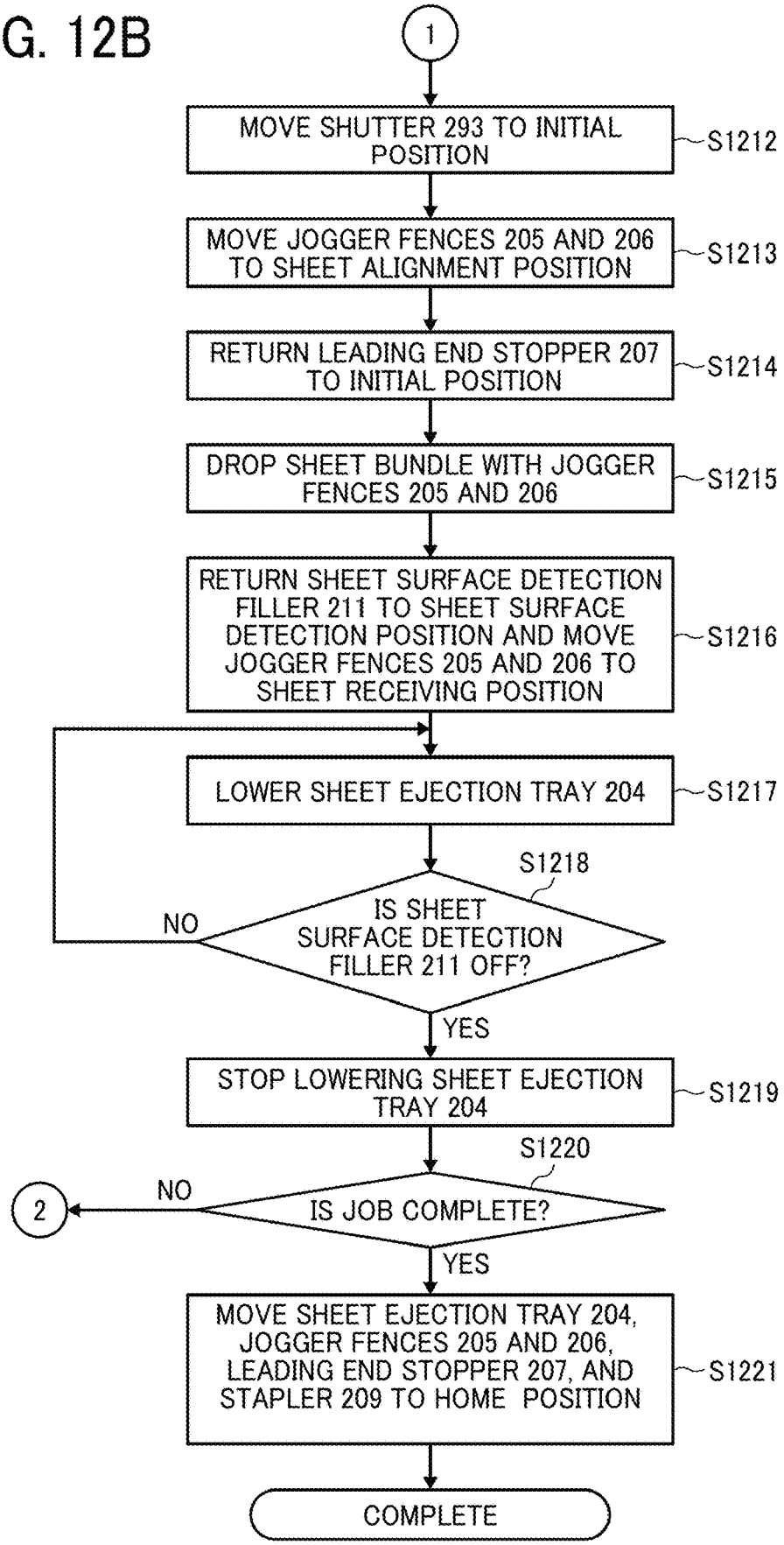

FIG. 12 including FIGS. 12*a* and 12B is a flowchart of a series of operation performed at the stapler 209 described above in a stapling mode, according to the present embodiment. The operations in this flowchart are performed based on instructions or control signals sent from the controller 260. Note that details of the operation have been described as above, a brief description is given below.

When the operation in the stapling mode is started, the ejection tray 204 and the jogger fences 205 and 206 are moved from the home position to the sheet receiving position, and the stapler 209 is moved from the home position to the predetermined stapling position (S1201). Then, the leading end stopper 207 is moved from the home position to the sheet receiving position, and the sheet surface detection feeler 211 is retracted from the detection position (S1202).

When the sheet P is discharged from the sheet discharge roller pair 203 (S1203), the rear end guide 208 descends to press the sheet P from above (S1204), and the jogger fences 205 and 206 and the leading end stopper 207 align the sheets P (S1205). After the sheets P are aligned, the jogger fences 205 and 206 and the leading end stopper 207 are moved to the sheet receiving position, and the rear end guide 208 is lifted (S1206).

The controller 260 determines whether the sheet P is the last sheet (S1207) and if the sheet P is not the last sheet (NO in S1207), the process returns to S1203, and steps from S1203 to S1207 are repeated until the sheet P is the last sheet. If the sheet P is the last sheet (YES in S1207), the leading end stopper 207 moves to the retreat position (S1208). Thereafter, the jogger fences 205 and 206 are moved to the stapling position while holding the sheet bundle Pb (S1209).

After the jogger fences 205 and 206 are moved to the stapling position, the controller 260 drives the shutter driver 296 to move the shutter 293 to the closing position (S1210). When the shutter 293 moves to the closing position, the power supply circuit to the driver 292 is closed. Thus, the binding process by the stapler 209 is executed (S1211). When the binding process ends, the shutter driver 296 is operated to return the shutter 293 from the closing position to the initial position (S1212).

After the shutter 293 returns to the initial position and the opening is opened, the jogger fences 205 and 206 are moved to the sheet discharge position (S1213). After the jogger fences 205 and 206 are moved, the leading end stopper 207 is also returned to the initial position (S1214). Then, the jogger fences 205 and 206 are moved away from each other to drop the sheet bundle Pb (S1215).

After the sheet bundle Pb falls onto the ejection tray 204, the sheet surface detection feeler 211 is returned (moved) to the detection position, and the jogger fences 205 and 206 are moved to the sheet receiving position (S1216), and the ejection tray 204 is lowered (S1217). This lowering of the ejection tray 204 is performed until the sheet surface detection sensor is turned off (loop of NO in S1218). When the sheet surface detection sensor is turned off (YES in S1218), the lowering of the ejection tray 204 is stopped (S1219).

Thereafter, the controller 260 determines whether the job is completed (S1220). When the job is not completed (NO in S1220), the process returns to S1202. When the job is completed (YES in S1220), the ejection tray 204, the jogger fences 205 and 206, the leading end stopper 207, and the stapler 209 are moved to the home position (S1221), and the process described in the flowchart of FIG. 12 ends. Note that the jogger fences 205 and 206 may be moved to the sheet receiving position immediately before S1216, instead of S1220.

As described above, performing the binding after the shutter 293 closes the opening (S1211) allows to supply power to the driver 292 of the stapler 209 by the changeover switch 297 and to perform the binding process when the gap of the shutter 293 is equal to or less than the thickness of the predetermined number of sheets to be bound. When the gap of the shutter 293 is larger than the thickness of the predetermined number of sheets to be bound, the changeover switch 297 does not operate and power is not supplied to the driver 292 of the stapler 209. Accordingly, the binding process is not executed. At this time, when the signal of the changeover switch 297 is used as a trigger to transmit the signal of the binding process, the control signal for performing the binding process may not be transmitted.

Second Embodiment

Figure 13A:
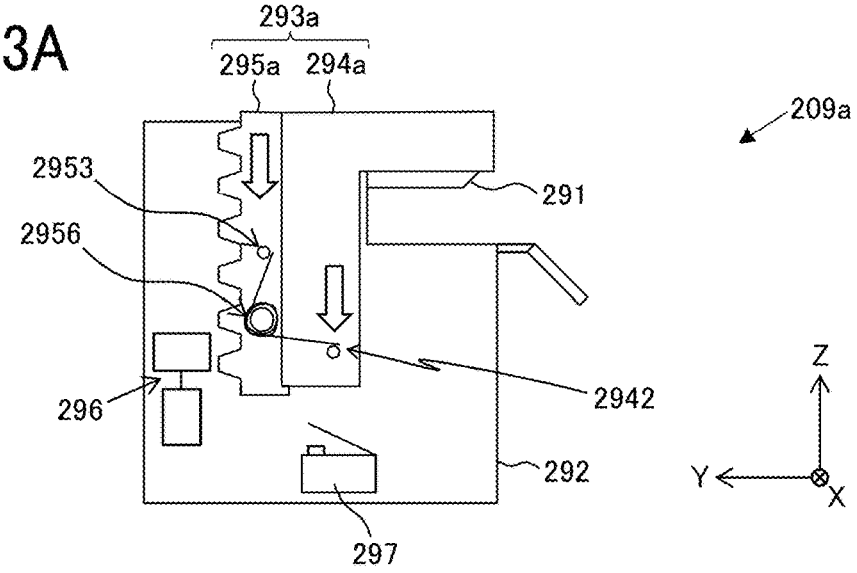
FIGS. 13A, 13B and 13C are diagrams each illustrating a configuration of a stapler of a post-processing apparatus according to a second embodiment of the present disclosure.
Figure 13B:
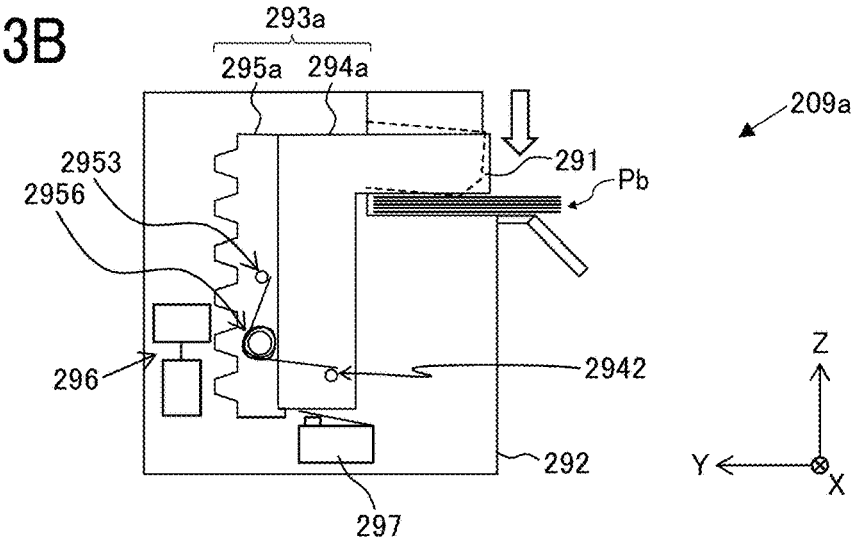
Figure 13C:
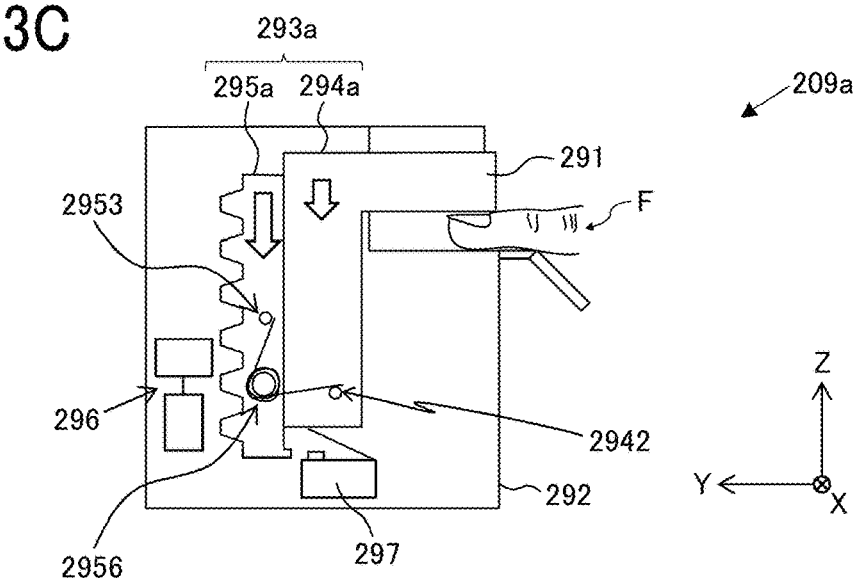

FIGS. 13A, 13B, and 13C are diagrams each illustrating a stapler 209 according to a further alternative embodiment of the present disclosure. As illustrated in FIGS. 13A, 13B, and 13C, a stapler 209*a* according to the second embodiment has a similar configuration to that of the first embodiment in regard to the clincher 291, the driver 292, the shutter driver 296, and the changeover switch 297 described above. However, the stapler 209*a* according to the second embodiment includes a shutter 293*a* that is different from the shutter 293 according to the first embodiment. Hereinafter, the differences in configuration between the shutter 293*a* according to the second embodiment and the shutter 293 according to the first embodiment are mainly described.

The shutter 293*a* according to the present embodiment includes an avoidance operation portion 294*a*, and a drive coupler 295*a*. The avoidance operation portion 294*a* avoids the closing operation when the movement of the shutter 293*a* is prevented when the shutter 293*a* moves to the closing position. The drive coupler 295*a* transfers a driving force to move the avoidance operation portion 294*a* to the closing position.

The avoidance operation portion 294*a* includes a fitted protrusion 2942 as a coupler to be interlocked with the drive coupler 295*a*. The drive coupler 295*a* includes a torsion spring 2956 as a coupling elastic member and a coupling protrusion 2953. One end of the torsion spring 2956 is fixed to the fitted protrusion 2942, and the other end of the torsion spring 2956 is fixed to the coupling protrusion 2953. The torsion spring 2956 is biased in a rewinding direction, and the avoidance operation portion 294*a* is biased downward.

The biasing force of the torsion spring 2956 may be set to be larger than the force for operating or pressing the changeover switch 297. When the shutter driver 296 is operated to move the drive coupler 295*a* downward, the torsion spring 2956 is also moved together with the drive coupler 295*a*. At this time, the other end of the torsion spring 2956 is fixed to the coupling protrusion 2953. Accordingly, force is applied to the fitted protrusion 2942 on another end of the torsion spring 2956 in a push-down direction. Therefore, in conjunction with the downward movement of the drive coupler 295*a*, the avoidance operation portion 294*a* also moves downward, that is, toward the changeover switch 297.

When the avoidance operation portion 294*a* moves to the closing position, the changeover switch 297 is pressed, and the clincher 291 and the driver 292 are in a state in which the binding operation can be executed.

Note that as the connecting elastic member, an elastic member such as a tension spring, a compression spring, or rubber may be used. Any elastic member may be used as long as the elastic member can exert the biasing force larger than the pressing force for the changeover switch 297.

As in the stapler 209*a*, using an elastic member as the coupling elastic member to engage with the avoidance operation portion 294*a* allows to return to the coupling state between the drive coupler 295*a* and the avoidance operation portion 294*a*, if the foreign object F is pulled out when the foreign object F is caught in the entrance (see FIG. 13C). Thus, returning to the avoidance operation can be facilitated. In addition, when the foreign object F is pulled out from the state in which the foreign object F is sandwiched, the shutter 293 returns to the initial position to press the changeover switch 297. Thus, there is a possibility that the state shifts to a state in which the binding process can be executed. However, in the case of the stapler 209*a*, the binding process is not executable unless the foreign object F is pulled out. Thus, the foreign object F is prevented from being sandwiched by the clincher 291 or the like.

Third Embodiment

Figure 14A:
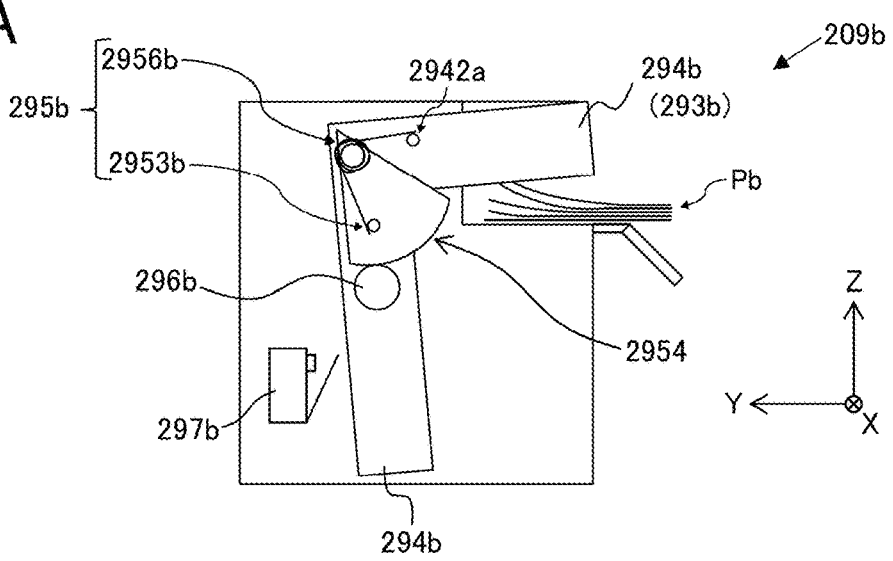
FIGS. 14A, 14B, and 14C are diagrams each illustrating a configuration of a stapler of a post-processing apparatus according to a third embodiment of the present disclosure.
Figure 14B:
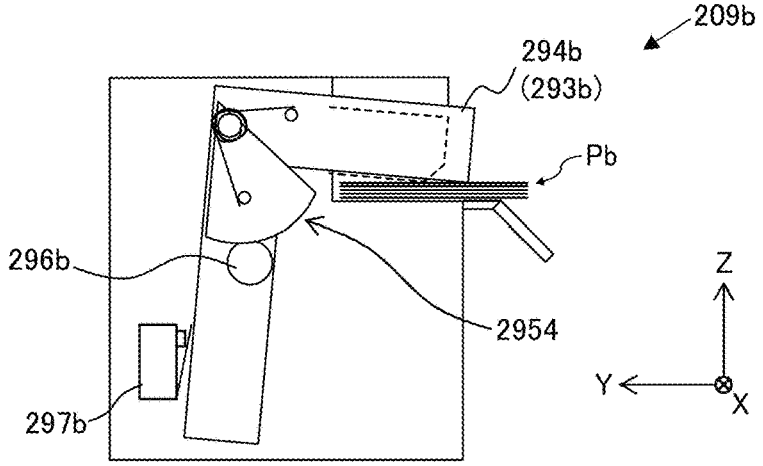
Figure 14C:
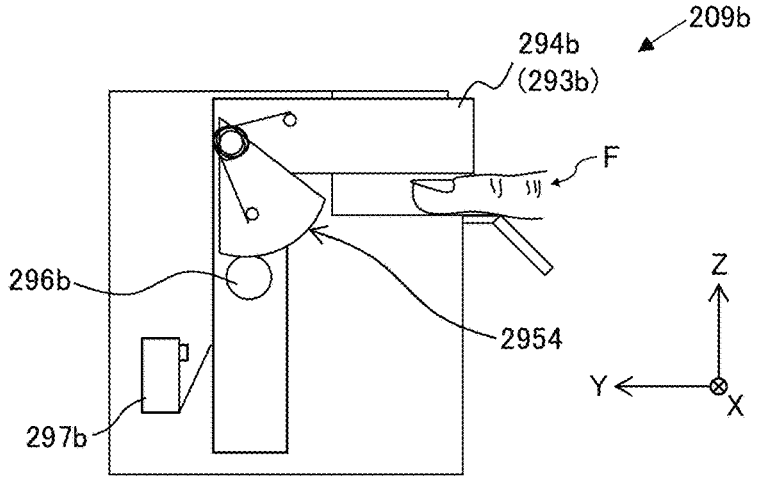

FIGS. 14A, 14B, and 14C are diagrams each illustrating a stapler 209*b* according to a further alternative embodiment of the present disclosure. As illustrated in FIGS. 14A, 14B, and 14C, a stapler 209*b* according to the third embodiment has a similar configuration as the first and second embodiments of the present disclosure and includes the clincher 291, the driver 292, a shutter 293*b*, the shutter driver 296, and the changeover switch 297 described above. However, the detailed configuration of the shutter 293 and the shutter driver 296 are different. Hereinafter, the differences in configuration between the shutter 293*a* according to the second embodiment and the shutter 293 according to the first embodiment are mainly described.

The avoidance operation portion 294*b* constituting the shutter 293*b* includes a closing portion and a switch operation portion. The closing portion functions to close the entrance. The switch operation portion functions to operate the changeover switch 297*b* and is rotated by a driving force of the drive coupler 295*b*.

The drive coupler 295*b* includes a fan-shaped gear 2954 that rotates by driving of the shutter driver 296*b*, and a torsion spring 2956*b* attached to a rotation shaft of the fan-shaped gear 2954. One end of the torsion spring 2956*b* is fixed to the coupling protrusion 2953*b*, and the other end of the torsion spring 2956*b* is fixed to the fitted protrusion 2942*b* formed in the avoidance operation portion 294*b*. The torsion spring 2956*b* is a connecting elastic member having a biasing force in a winding direction, and biases the avoidance operation portion 294*b* in a direction in which the entrance is closed.

The shutter driver 296*b* is a motor in which a gear is fixed to a rotation shaft of the motor and is engaged with the fan-shaped gear 2954. The fan-shaped gear 2954 rotates clockwise (CW) by the rotation of the shutter driver 296*b*. The coupling protrusion 2953*b* formed on the fan-shaped gear 2954 pushes one end of the torsion spring 2956*b* clockwise. The torsion spring 2956*b* is biased in the winding direction. Thus, the fitted protrusion 2942*b* fixed to the other end of the torsion spring 2956*b* is biased clockwise.

When the controller 260 rotates the shutter driver 296*b* in a series of controls to execute the binding process, the fan-shaped gear 2954 rotates clockwise and biases the fitted protrusion 2942*b* clockwise. Accordingly, the avoidance operation portion 294*b* closes the entrance (FIG. 14B). At this time, the switch operation portion of the avoidance operation portion 294*b* also rotates clockwise. As a result, the changeover switch 297*b* is pressed. The changeover switch 297*b* opens and closes the power supply circuit to the drivers of the driver 292 and the clincher 291. Thus, the power supply circuit is closed when the changeover switch 297*b* is pressed and the driver 292 and the clincher 291 are in a state in which the binding can be executed.

Note that also in the coupling elastic member according to the present embodiment, an elastic member such as a tension spring, a compression spring, or rubber may be used. Any elastic member may be used as long as the elastic member can exert the biasing force larger than the pressing force for the changeover switch 297.

Fourth Embodiment

Figure 15A:
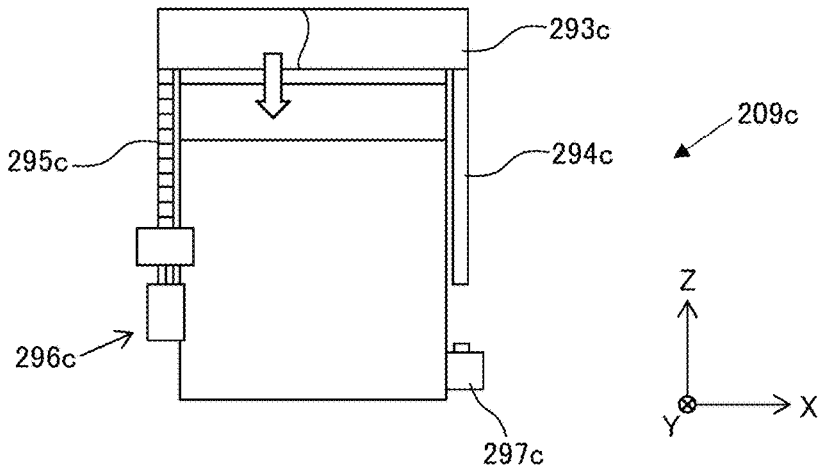
FIGS. 15A, 15B, and 15C are diagrams each illustrating a configuration of a stapler of a post-processing apparatus according to a fourth embodiment of the present disclosure.
Figure 15B:
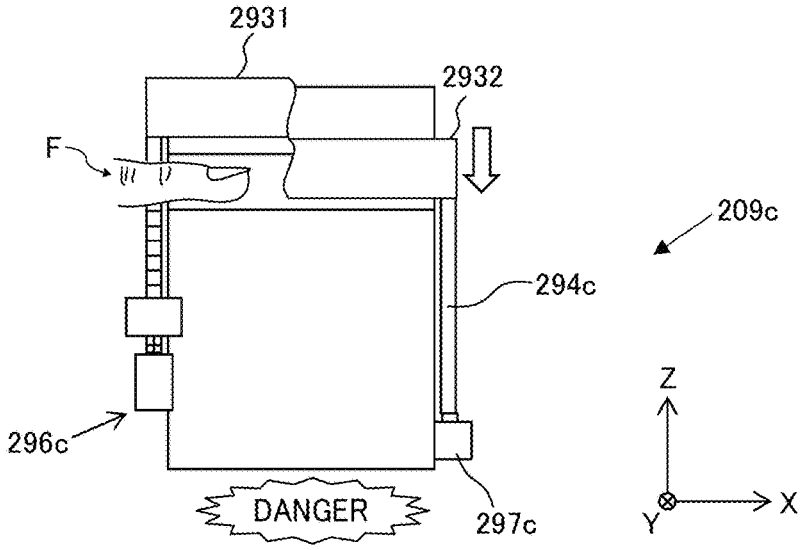
Figure 15C:
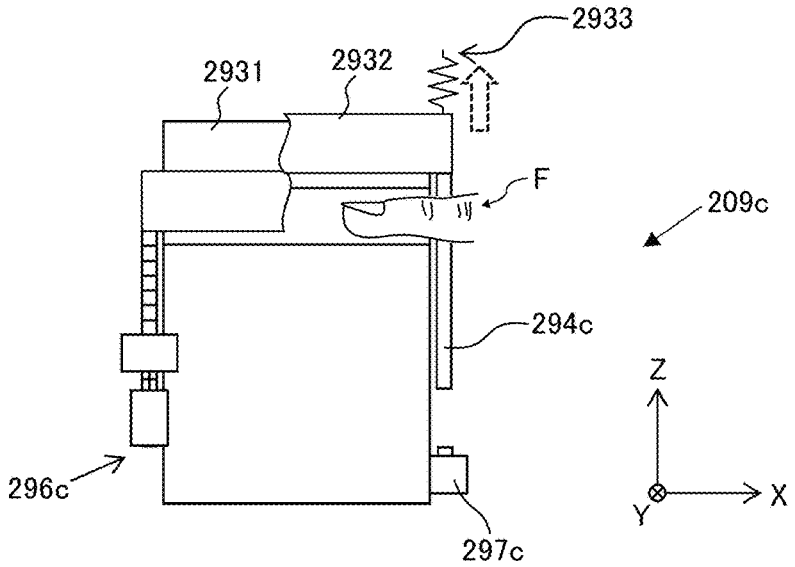

FIGS. 14A, 14B, and 14C are diagrams each illustrating a stapler 209*c* according to a further alternative embodiment of the present disclosure. As illustrated in FIGS. 15A, 15B, and 15C, a stapler 209*c* according to the present embodiment includes a shutter driver 296*c* disposed on a side face of the stapler 209*c* and a changeover switch 297*c* disposed on an opposite side face of the stapler 209*c*. A first shutter portion 2931 and a second shutter portion 2932 constituting a shutter 293*c* are integrally formed. A portion of the shutter 293*c* close to the drive coupler 295*c* is the first shutter portion 2931 and a portion of the shutter 293*c* close to the avoidance operation portion 294*c* is the second shutter portion 2932.

The shutter 293*c* includes a closing part that functions to close the entrance by transmitting driving force caused by the shutter driver 296*c* on the side close to the drive coupler 295*c*, and a switch operation portion that functions to operate the changeover switch 297*c*.

As illustrated in FIG. 15C, a tension coil spring 2933 as an elastic member is provided on the second shutter portion 2932 which is a part of the shutter 293*c*. The tension coil spring 2933 is an elastic member that biases the second shutter portion 2932 in a direction opposite to the operation direction of the changeover switch 297*c* with respect to the second shutter portion 2932.

As illustrated in FIG. 15A, the shutter 293*c* is integrally operated by the shutter driver 296*c*. However, in a state in which the shutter 293*c* is broken as illustrated in FIG. 15B, the first shutter portion 2931 and the second shutter portion 2932 are separated from each other, and the driving force caused by the drive coupler 295*c* is not transmitted to the avoidance operation portion 294*c*. At this time, the avoidance operation portion 294*c* is operable without being interlocked with the operation of the drive coupler 295*c*.

In this case, as illustrated in FIG. 15B, the avoidance operation portion 294*c* may move downward due to its own weight and press the changeover switch 297*c*. Then, even if the foreign object F is caught on a side close to the drive coupler 295*c*, the binding operation is executable.

Therefore, as illustrated in FIG. 15C, the second shutter portion 2932 is biased by the tension coil spring 2933 so as not to move downward even when the second shutter portion 2932 is separated from the drive coupler 295*c*. Thus, the stapler 209*c* is not able to execute the binding operation in a state in which the shutter 293*c* sandwiches the foreign object F. That is, according to the present embodiment, even if the shutter 293*c* is broken and the avoidance operation portion 294*c* and the drive coupler 295*c* are separated from each other, control can be performed such that the binding operation is not executable when the foreign object F is interposed. Note that the biasing force of the tension coil spring 2933 may be small enough to prevent the separated shutter 293*c* from hanging down by its own weight.

Fifth Embodiment

Figure 16A:
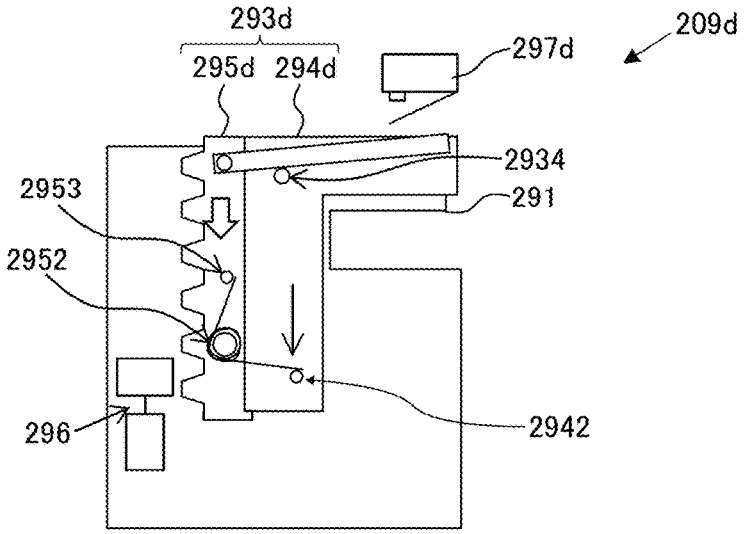
FIGS. 16A, 16B, and 16C are diagrams each illustrating a configuration of a stapler of a post-processing apparatus according to a fifth embodiment of the present disclosure.
Figure 16B:
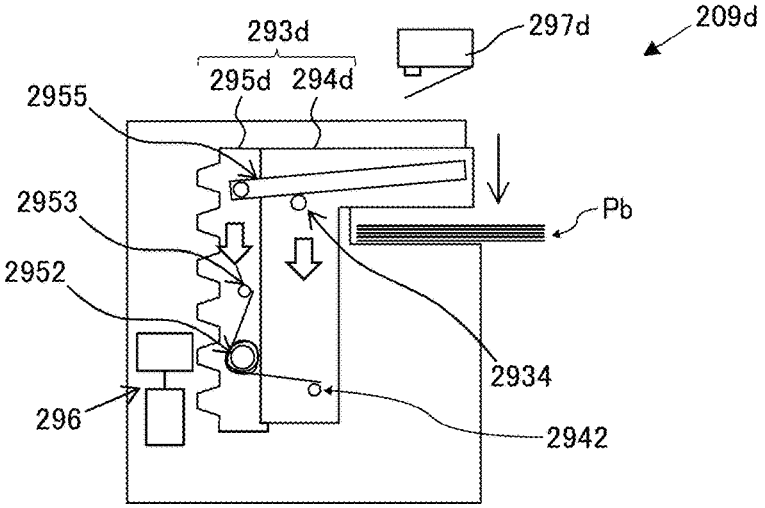
Figure 16C:
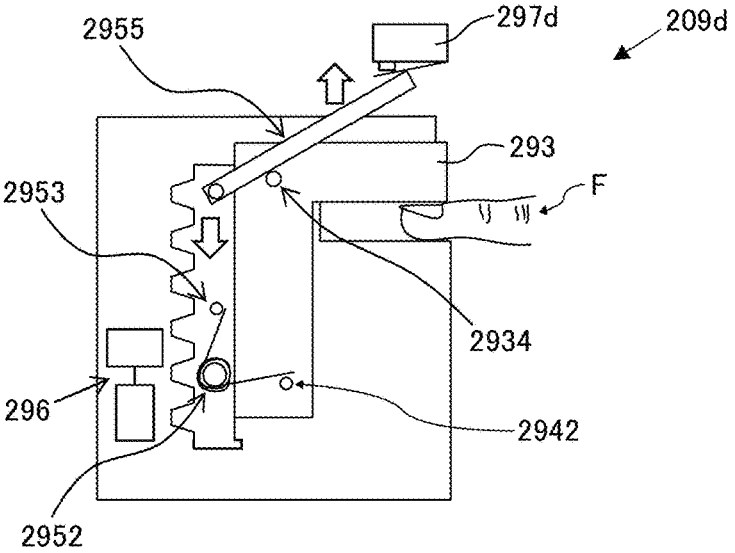

FIGS. 16A, 16B, and 16C are diagrams each illustrating a stapler 209*d* according to a third further alternative embodiment of the present disclosure. The stapler 209*d* illustrated in FIGS. 16A, 16B, and 16C includes a shutter 293*d* having a different configuration from the configuration described above. Hereinafter, the shutter 293*d* is mainly described.

An avoidance operation portion 294*d* includes a fitted protrusion 2942 as a coupling portion that is interlocked with the drive coupler 295*d*, and an avoidance detection protrusion 2934. The drive coupler 295*a* includes a torsion spring 2956 as a coupling elastic member, a coupling protrusion 2953, and a detection rod 2955. The detection rod 2955 is rotatably fixed to a pin provided in the drive coupler 295*a*, and moves such that a free end of the detection rod 2955 draws an arc around the pin as the rotation center.

In the stapler 209*d*, the shutter driver 296, which is a driving source for operating the shutter 293*d*, also serves as a driving source for the driver 292 and the clincher 291 to perform the binding operation. Therefore, the controller 260 controls the driver 292 to operate after the shutter 293 operates to close the entrance to prevent the foreign object F from entering.

In this case, the same driving source is used. Thus, a current flows through the power supply circuit to the driver 292 and the like. For this reason, when the foreign object F thicker than the sheet bundle Pb is sandwiched after the shutter 293*d* is operated, it is necessary to stop the power supply to the driver 292 and the like.

Therefore, when the foreign object F is caught, that is, when the movement of the avoidance operation portion 294*d* to the closing position in conjunction with the drive coupler 295 is prevented, the detection rod 2955 is pushed up by the avoidance detection protrusion 2934. The changeover switch 297*d* is disposed at a position at which the changeover switch 297*d* can be operated by the pushed-up detection rod 2955. When the changeover switch 297*d* is operated, power supply to the driver 292 or the like is interrupted.

As described above, in the stapler 209*d* according to the present embodiment, the changeover switch 297*d* detects the position at which the shutter 293*d* sandwiches the foreign object F thicker than the sheet bundle Pb. In addition, the changeover switch 297*d* is not detected at a position at which the sheet bundle Pb is sandwiched. Thus, safety can be secured.

Sixth Embodiment

Figure 17A:
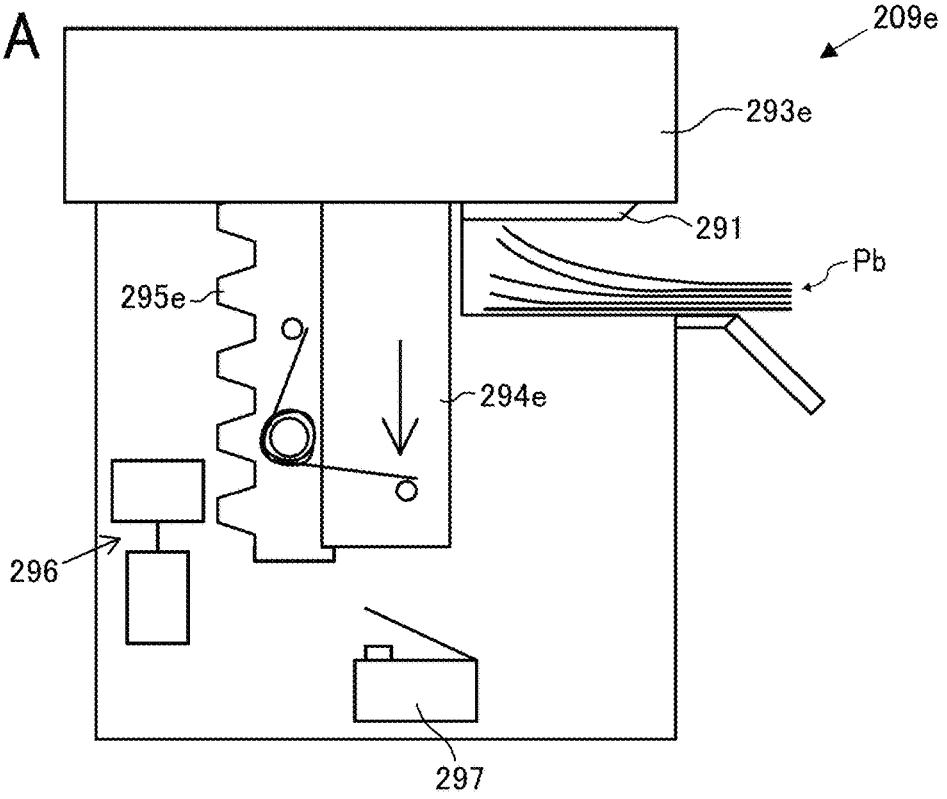
FIGS. 17A and 17B are diagrams each illustrating a configuration of a stapler of a post-processing apparatus according to a sixth embodiment of the present disclosure.
Figure 17B:
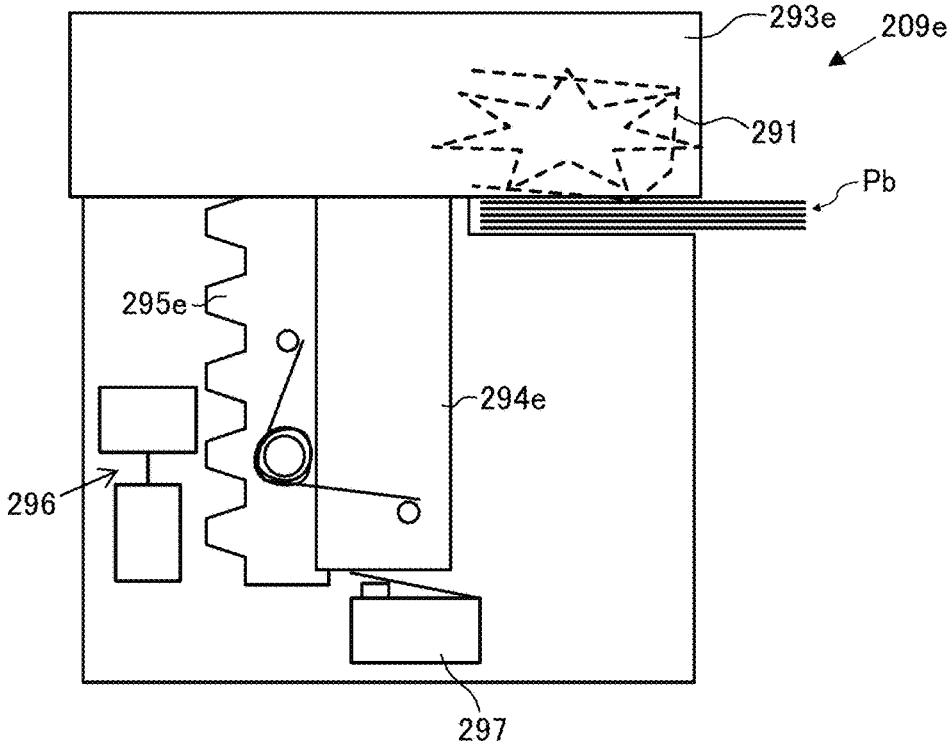

FIGS. 17A and 17B are diagram each illustrating a stapler 209*e* according to a sixth further alternative embodiment of the present disclosure. As illustrated in FIGS. 17A and 17B, a stapler 209*e* according to the present embodiment is configured such that the shutter 293*e* covers the entire circumference of the binding position (the space in which the binding process is executed by the clincher 291 and the driver 292).

For example, in the shutter 293 of the stapler 209, it is necessary to reduce the conveyance resistance of the sheet P to receive the sheet bundle Pb whose end is largely bent at the binding position. Therefore, it is necessary to provide a large opening area for the entrance to the stapler 209. When the opening area is large, sound generated when the binding operation is performed is radially spread.

Therefore, in the stapler 209*e*, the shutter 293*e* covers the opening at the binding position up to the thickness of the sheet bundle Pb, such that noise generated during the binding operation can be insulated (see FIG. 17B).

Seventh Embodiment

Figure 18A:
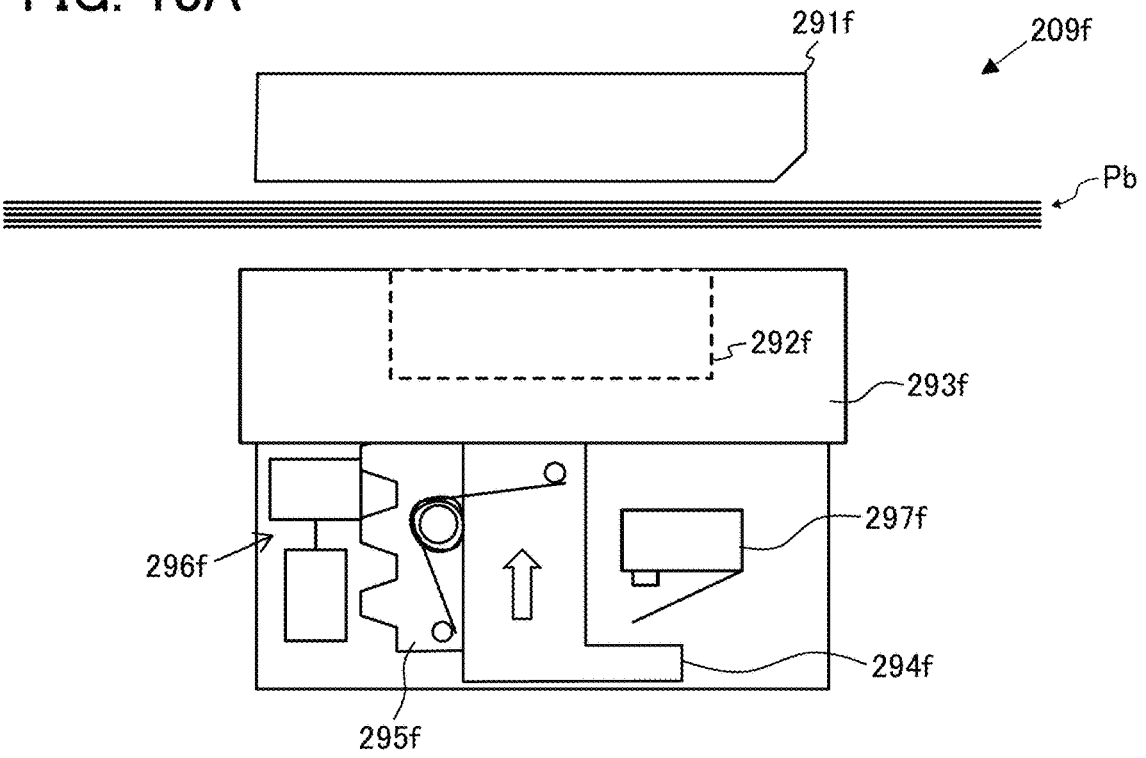
FIGS. 18A and 18B are diagrams each illustrating a configuration of a stapler of a post-processing apparatus according to a seventh embodiment of the present disclosure.
Figure 18B:
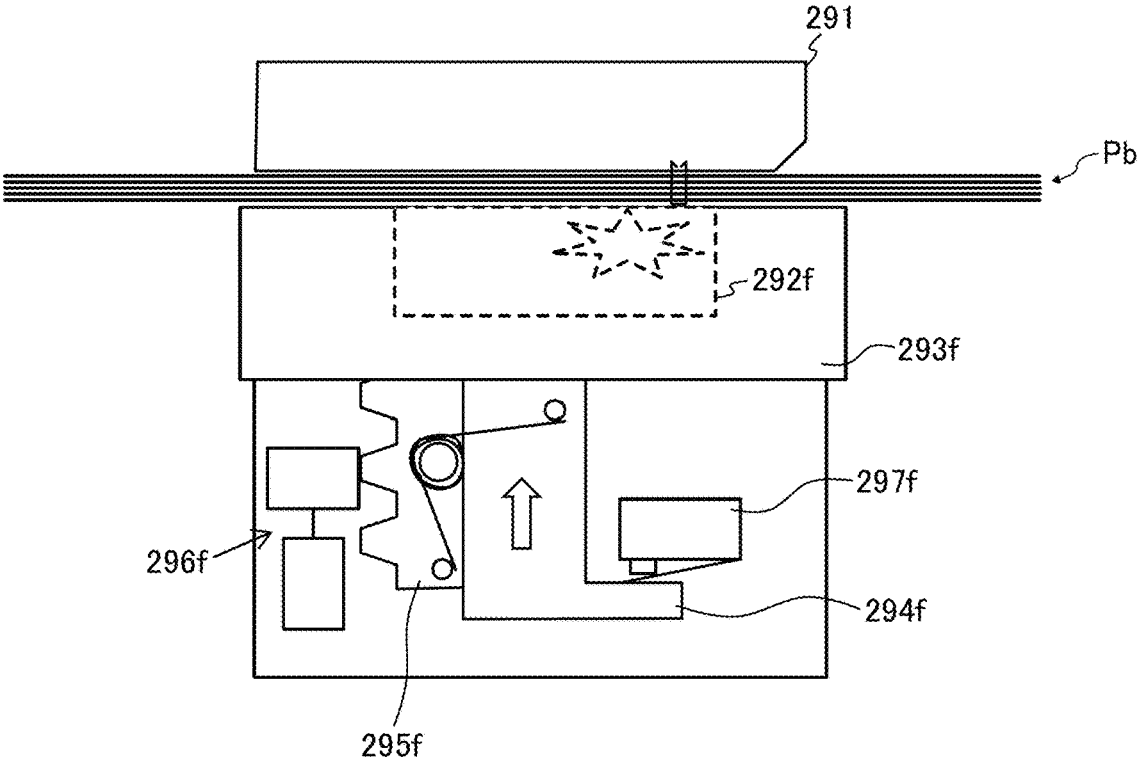

FIGS. 18A and 18B are diagrams each illustrating a stapler 209*f* according to a further alternative embodiment of the present disclosure. The stapler 209 described above executes the binding on the ends of the sheet bundle Pb. The stapler 209*f* according to the present embodiment is an example of a saddle stitching device that performs a stitching processing on the sheet bundle Pb at middle portions in the conveyance direction.

As illustrated in FIGS. 18A and 18B, the stapler 209*f* according to the present embodiment has a basic configuration similar to the configuration of the stapler 209 described above. However, there are differences in the details of the configuration. The differences in configuration between the stapler 209*f* and the stapler 209 are mainly described below.

As illustrated in FIG. 18A, a driver 292*f* that pushes out the staples N and a clincher 291*f* that bends the staples N are separately disposed in two spaces in the stapler 209*f* and the binding position is set at a position at which the sheet bundle Pb is sandwiched near the center in the longitudinal direction of the sheet bundle Pb. In the stapler 209*f* according the seventh embodiment of the present disclosure, the position of the clincher 291*f* is fixed and does not move when the driver 292*f* operates.

Therefore, the shutter 293*f* (the avoidance operation portion 294*f* and the drive coupler 295*f*) is disposed on a side on which the driver 292*f* is disposed, and the shutter 293*f* is interlocked with the movement direction of the driver 292*f*. In addition, a changeover switch 297*f* is disposed on the side of the avoidance operation portion 294*f*. The changeover switch 297*f* is not pressed when the changeover switch 297*f* cannot interlock with the drive coupler 295*f*.

When the changeover switch 297*f* is not pressed, the driver 292*f* is not operated, and when the foreign object F enters a binding position which is a clearance between the driver 292*f* and the clincher 291*f*, the operation of the driver 292*f* is disabled.

In the case of saddle stitching, since the binding position is near the center of the sheet bundle Pb, the shutter 293*f* of the stapler 209*f* must cover the entire periphery of the unit so that the foreign object F does not enter the binding position.

Eighth Embodiment

Figure 19:
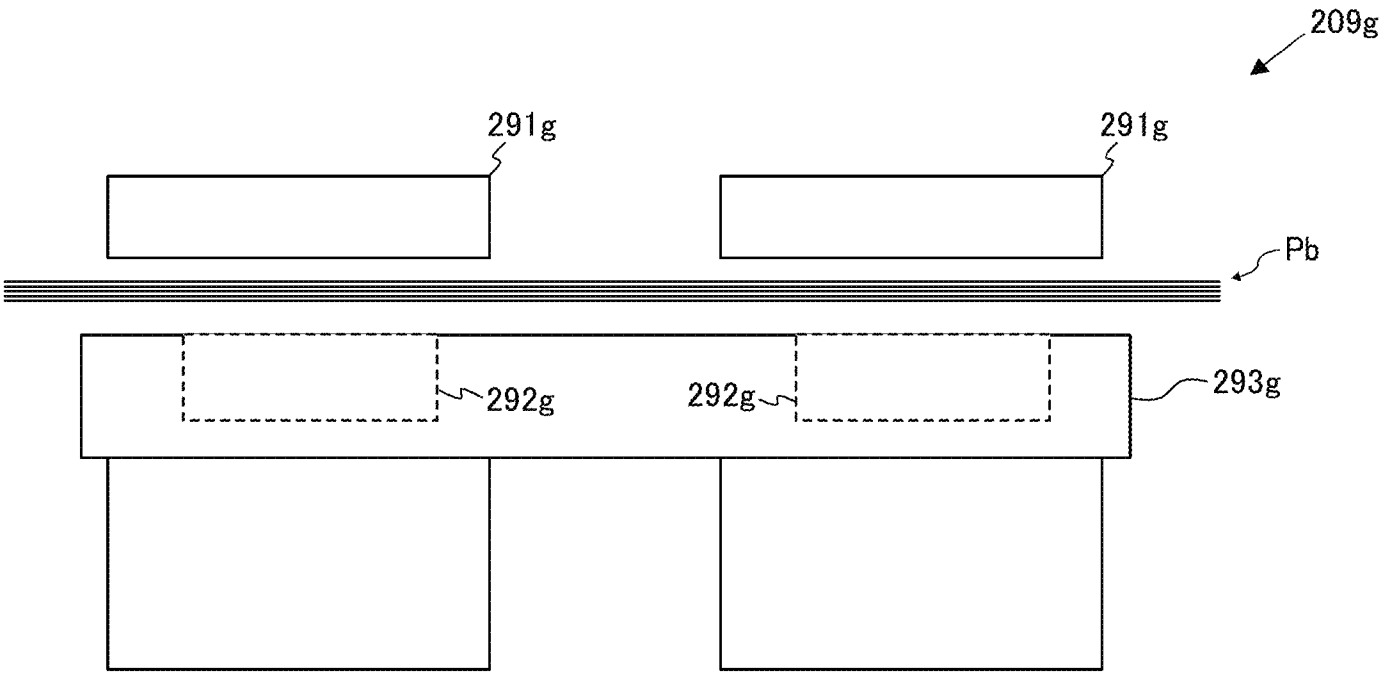
FIG. 19 is a diagram illustrating a configuration of a stapler of a post-processing apparatus according to an eighth embodiment of the present disclosure.

FIG. 19 is a diagram illustrating a stapler 209*g* according to a further alternative embodiment of the present disclosure. The stapler 209*g* illustrated in FIG. 19 is another example of the saddle stitching unit that performs the stitching process on the sheet bundle Pb at the intermediate portion in the conveyance direction.

The stapler 209*g* according to the present embodiment is a device capable of executing the saddle stitching processing on the sheet bundle Pb at a plurality of different positions. In the case of a device that is divided into a plurality of pieces, such as the stapler 209*g*, the binding operation is simultaneously executed at a plurality of binding positions. Therefore, preferably, a shutter 293*g* as the closing member is integrated so as to cover the entire binding positions.

Ninth Embodiment

Figure 20:
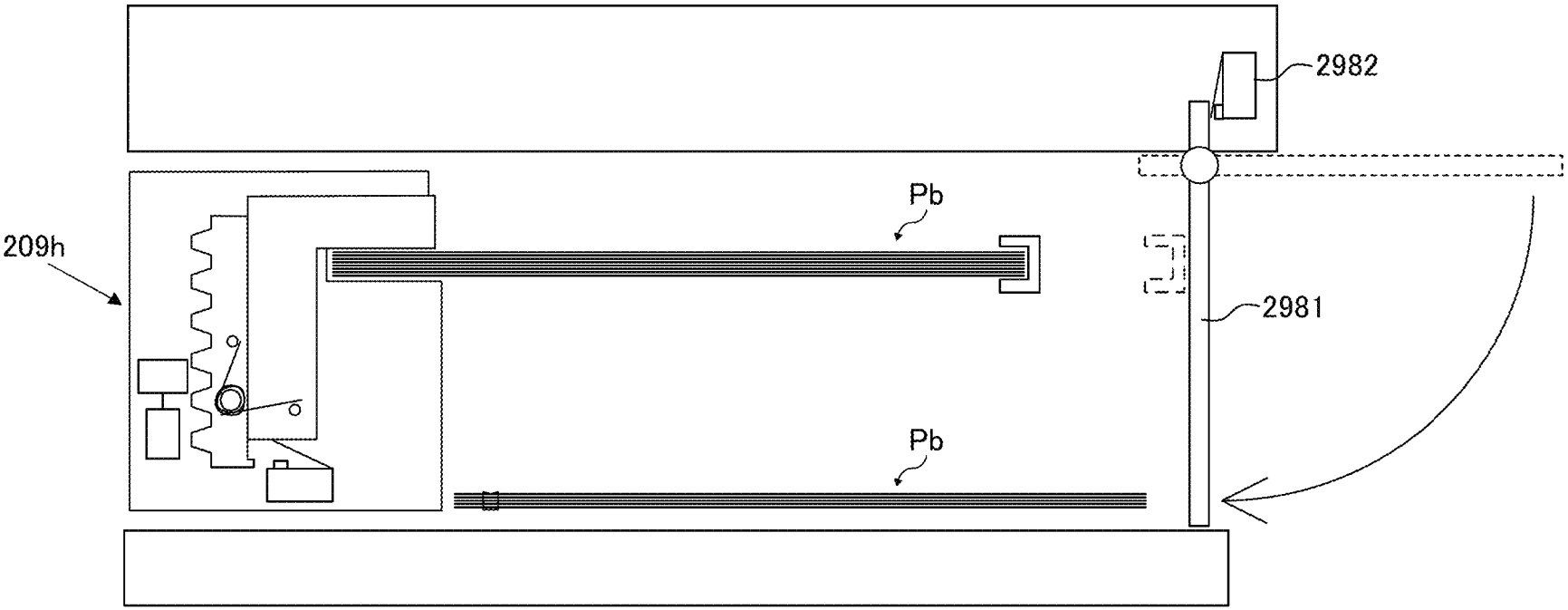
FIG. 20 is a diagram illustrating a configuration of a stapler of a post-processing apparatus according to a ninth embodiment of the present disclosure.

FIG. 20 is a diagram illustrating a stapler unit 209*h* according to a ninth further alternative embodiment of the present disclosure. As illustrated in FIG. 20, a stapler 209*h* according to the present embodiment includes, in addition to the configuration of the stapler 209 and the like described above, a protective cover 2981 as a cover constituting a part of a housing of the post-processing apparatus 200, and a protective switch 2982 as a cover detector operated by the protective cover 2981. The protective cover 2981 is a cover that opens and closes an opening serving as an entry path from the outside of the apparatus to the inside of the post-processing apparatus 200.

The stapler 209 and the like described above function when the thickness of the foreign object F is larger than the thickness of the sheet bundle Pb. However, the sheet bundle Pb may be thicker than the foreign object F (for example, the user's finger). In this case, the binding operation cannot be executed only by the shutter 293 and the like according to the embodiments other than the present embodiment described above. That is, an additional control unit is required to make the binding operation executable on the sheet bundle Pb thicker than the assumed thickness of the foreign object F.

Therefore, in the stapler 209*h* according to the present embodiment, whether the binding operation can be performed is controlled in cooperation with the open and close state of the protective cover 2981 which prevents the foreign object F from entering the inside of the apparatus which is the installation space of the stapler 209*h*.

When the protection cover 2981 is at the open position (indicated by a dotted line in FIG. 20), the protection switch 2982 is not pressed. When the protection cover 2981 is at the closing position (indicated by a solid line in FIG. 20), the protection switch 2982 is pressed. Closing the power supply circuit to the driver 292 and the like only when the protection switch 2982 is pressed and the changeover switch 297 is also pressed allows to perform control so as not to execute the binding operation when there is a possibility that the foreign object F is caught at the binding position of the stapler 209*h*.

For example, FIG. 21 describes a combination of the state of the changeover switch 297 and the state of the protection switch 2982, and a state of power supply to the stapler 209*h*. The state of the changeover switch 297 and the protection switch 2982 is represented by "1" for "ON" and "0" for "OFF". The state of the power supply to the stapler 209*h* is represented by "1" and "0". "1" represents the state in which stapler 209*h* is in the power supply state and "0" represents the state in which stapler 209*h* is not in the power supply state.

As described in FIG. 21, when one of the changeover switch 297 and the protection switch 2982 is ON, power is supplied to the power supply circuit of the stapler 209*h*. In other words, the power supply circuit of the stapler 209*h* may have a circuit configuration in which an OR circuit is formed by the changeover switch 297 and the protection switch 2982.

The stapler 209*h* can execute the binding operation for the sheet bundle Pb thicker than the predetermined number of sheets to be bound. Further, the difference in thickness between the foreign object F and the sheet bundle Pb can be detected. Thus, when the gap between the shutter 293 and the driver 292 is narrower than the thickness of the predetermined number of sheets to be bound, the binding process is executed by the operation of the changeover switch 297.

When the gap between the shutter 293 and the driver 292 is wider than the predetermined number of sheets to be bound, the power supply to the driver 292 is stopped. Therefore, even when the sheet bundle Pb is removed from the binding position and the foreign object F enters the binding position during the binding operation on the sheet bundle Pb, the binding operation can be controlled so as to be unfeasible.

Figure 22A:
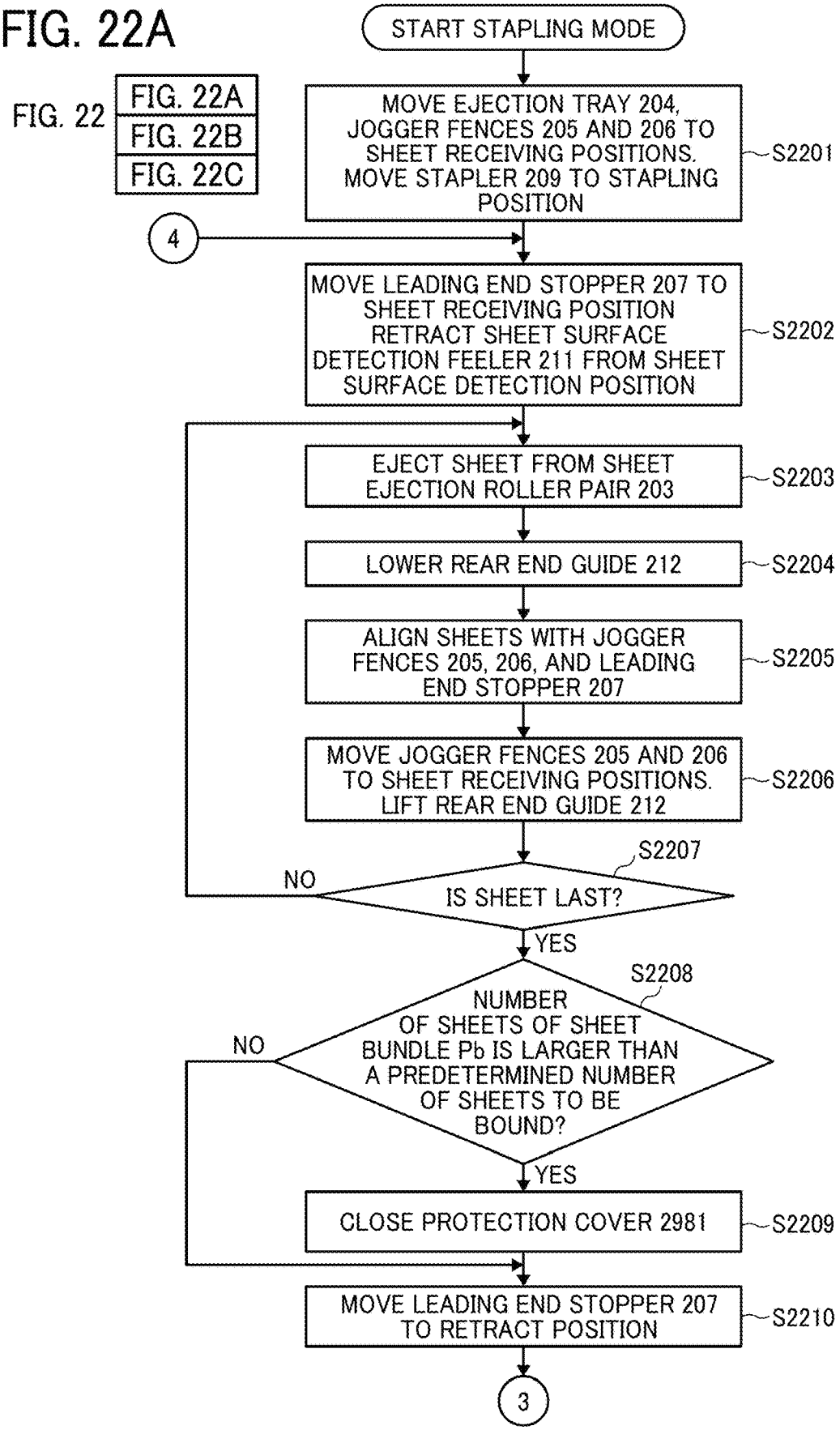
FIGS. 22A, 22B, and 22C is a flowchart of a series of operations performed at a stapler in a stapling mode, according to the ninth embodiment of the present disclosure.
Figure 22B:
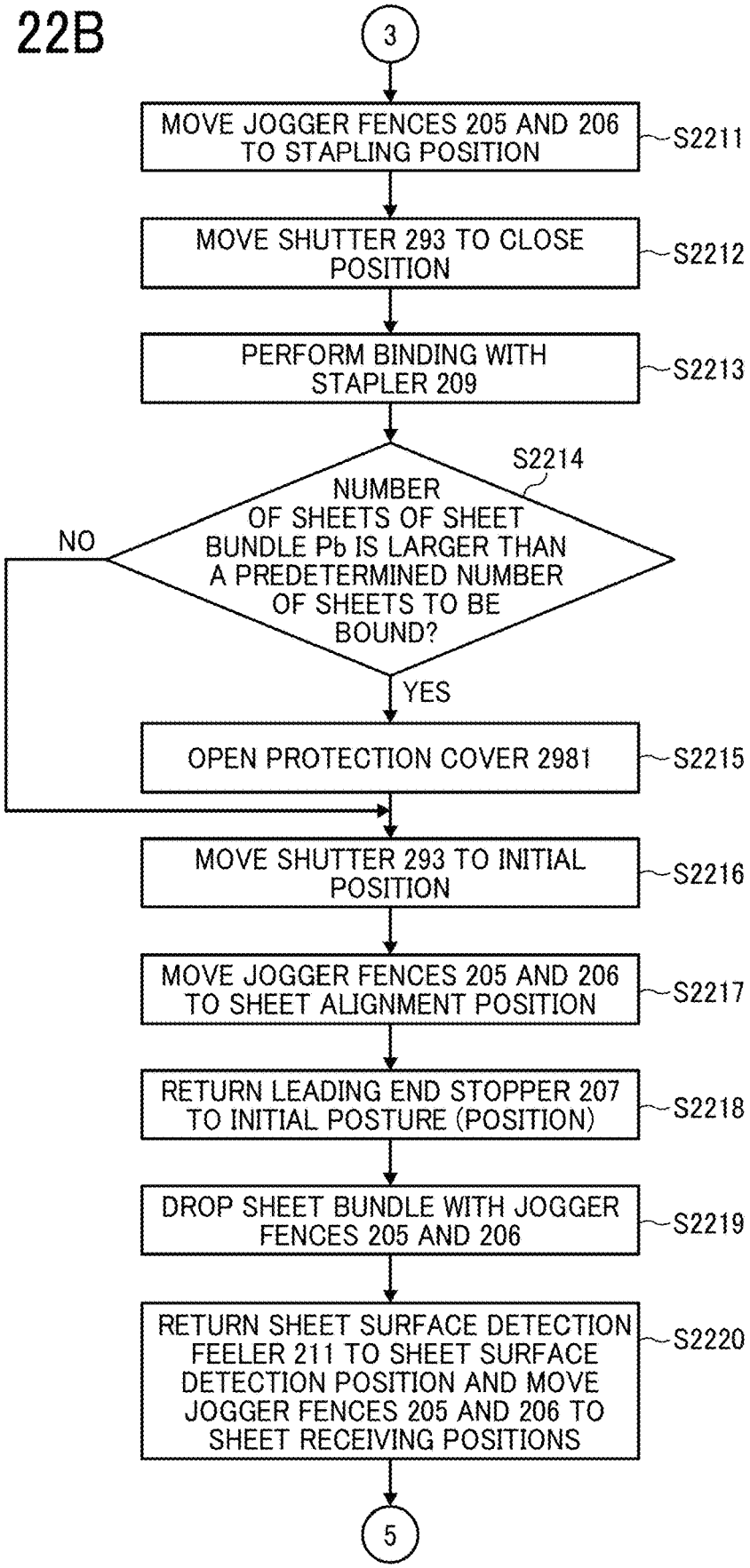
Figure 22C:
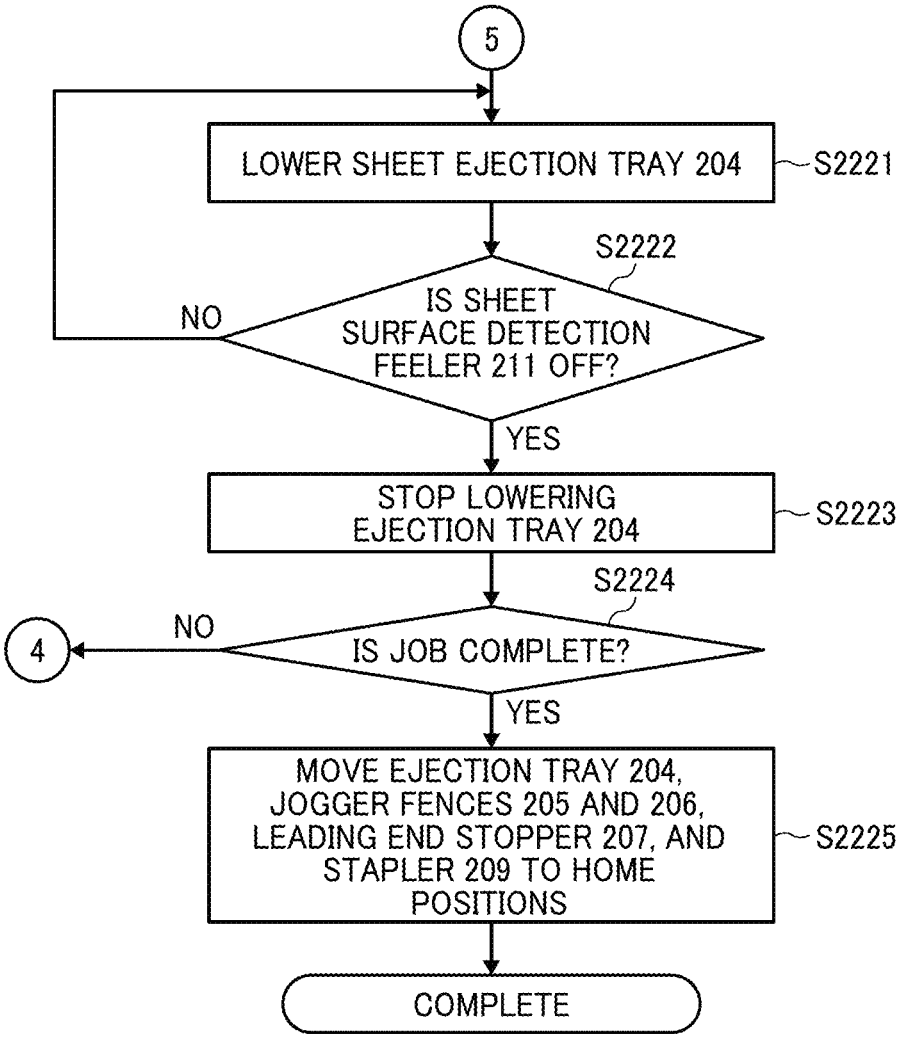

FIG. 22 including FIGS. 22A, 22B, and 22C is a flowchart of a series of operations process of performed at the stapler 209*h* in a stapling mode, according to the ninth embodiment of the present disclosure. The operations in this flowchart are performed based on instructions or control signals sent from the controller 260 and some of these operations are in common with the operations performed by the stapler 209 already described with reference to FIG. 12. Hereinafter, the differences in configuration between the shutter 293*a* according to the second embodiment and the shutter 293 according to the first embodiment are mainly described.

After the operation in the stapling mode is started, the controller 260 determines if the sheet P is final (YES in S2207). Thereafter, the controller 260 determines whether the number of sheets of the sheet bundle Pb is larger than a predetermined number of sheets to be bound (S2208). When the number of sheets of the sheet bundle Pb is larger than the predetermined number of sheets to be bound (YES in S2208), the protection cover 2981 is closed (S2209). Then, the leading end stopper 207 is moved to the retreat position (S2210). When the predetermined number of sheets is smaller than the predetermined number of sheets to be bound (NO in S2208), the protection cover 2981 is not closed and the leading end stopper 207 is moved to the retracted position (S2210).

Thereafter, the jogger fences 205 and 206 are moved to the stapling positions while holding the sheet bundle Pb (S2211), the shutter 293 is moved to the closing position (S2212), and the binding process is executed according to the table illustrated in FIG. 21 (S2213).

After the binding process is completed, whether the number of sheets of the sheet bundle Pb is larger than the predetermined number of sheets to be bound is determined again (S2214). When the number of sheets of the sheet bundle Pb is larger than the predetermined number of sheets to be bound (YES in S2214), the protection cover 2981 is opened (S2215). Then, the shutter 293 is returned to the initial position (S2216). When the predetermined number of sheets of the sheet bundle Pb is smaller than the predetermined number of sheets to be bound (NO in S2214), the shutter 293 is returned to the initial position while the protective cover 2981 remains open (S2216).

The procedure after S2217 and thereafter are the same as S1213 and thereafter. Therefore, description thereof is omitted.

As described above, in the stapler 209*h*, while the protection cover 2981 is closed, the sheets P and the sheet bundle Pb inside the post-processing apparatus 200 cannot be taken out, which is inconvenient. Therefore, when the shutter 293 of the stapler 209*h* is closed, it is not necessary to close the protection cover 2981. Thus, when a small number of sheets are to be bound, the safety can be secured based on the operation of the changeover switch 297 by the shutter 293. Thus, the safety is not impaired even if the protection cover 2981 is not closed. That is, the convenience of taking out the sheets P and the sheet bundle Pb inside the post-processing apparatus 200 during the operation of the post-processing apparatus 200 can be ensured.

Further, for example, when the sheet bundle Pb thicker than the user's finger is to be bound, the opening on the front surface of the post-processing apparatus 200 is closed by the protection cover 2981 and the protection switch 2982. Then, it is detected that the user's finger is not inserted carelessly to secure the safety of the user.

The above-described embodiments may be implemented in combination with each other.

The present disclosure is not limited to specific embodiments described above, and numerous additional modifications and variations are possible in light of the teachings within the technical scope of the appended claims. It is therefore to be understood that, the disclosure of the present specification may be practiced otherwise by those skilled in the art than as specifically described herein, and such, modifications, alternatives are within the technical scope of the appended claims. Such modifications and alternatives are within the technical scope of the present disclosure.

In the above descriptions, the term "printing" in the present disclosure may be used synonymously with, e.g. the terms of "image formation", "recording", "printing", and "image printing".

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A post-processing apparatus comprising:

a binding device configured to bind a sheet bundle;

a closing device configured to close an entrance to a binding position at which the binding device binds the sheet bundle;

a driver configured to move the closing device to a closing position at which the closing device closes the entrance; and a changeover switch configured to perform switching to implement a state in which the binding device is able to bind the sheet bundle when the closing device moves to the closing position, wherein the closing device includes:

an avoidance operation portion configured to move to the closing position to operate the changeover switch, and a drive coupler coupled to the avoidance operation portion to move the avoidance operation portion to the closing position by a driving force caused by the driver, wherein a coupling state between the avoidance operation portion and the drive coupler is released when movement of the avoidance operation portion to the closing position is prevented.

2. The post-processing apparatus according to claim 1, wherein the coupling state between the avoidance operation portion and the drive coupler is released when the movement of the avoidance operation portion to the closing position is prevented by a foreign object having a thickness larger than a thickness of the sheet bundle.

3. The post-processing apparatus according to claim 2, wherein the coupling state between the avoidance operation portion and the drive coupler is formed by fitting between the avoidance operation portion and the drive coupler.

4. The post-processing apparatus according to claim 1, further comprising a coupling elastic member configured to apply a biasing force to the avoidance operation portion and the drive coupler to form the coupling state between the avoidance operation portion and the drive coupler, and wherein the coupling state formed by the coupling elastic member is released when a force applied to the avoidance operation portion interlocked with the drive coupler is larger than the biasing force of the coupling elastic member, the force being caused when the movement of the avoidance operation portion to the closing position is prevented.

5. The post-processing apparatus according to claim 1, wherein a portion of the closing device that operates the changeover switch when the avoidance operation portion is moved to the closing position is biased in a direction opposite to a direction in which the avoidance operation portion is moved to the closing position, and wherein the biasing force applied to the portion of the closing device is smaller than a driving force of the driver.

6. The post-processing apparatus according to claim 1, wherein the driver is also configured to supply a driving force for a binding operation by the binding device.

7. The post-processing apparatus according to claim 1, wherein the closing device includes a closing member configured to cover the entrance.

8. The post-processing apparatus according to claim 1 comprising:

a cover configured to open and close an opening serving as an entry path from an outside of the post-processing apparatus to the binding position; and a cover detector configured to detect an open state and a close state of the cover, wherein the post-processing apparatus is configured to switch between an executable state and a non-executable state of binding based on a combination of states of the changeover switch and the cover detector.

9. An image forming system comprising:

an image forming apparatus configured to form an image on a sheet, and the post-processing apparatus according to claim 1, the post-processing apparatus being configured to bind a sheet bundle of sheets on which images have been formed by the image forming apparatus.

* * * * *